United States Patent [19]

Lyon et al.

[11] Patent Number: 4,970,958

[45] Date of Patent: Nov. 20, 1990

[54] MARINE MINE FIRE CONTROL MECHANISM

[75] Inventors: Robert J. Lyon, Silver Spring, Md.; Richard L. Lorenz, deceased, late of Chicago, Ill., by Gertrude M. Lorenz, executor

[73] Assignee: The United States of America as represented by the Secretary of the Navy, Washington, D.C.

[21] Appl. No.: 248,820

[22] Filed: Dec. 31, 1962

[51] Int. Cl.[5] ..... F42B 22/42

[52] U.S. Cl. ..... 102/417

[58] Field of Search ..... 102/18, 19.2, 417

[56] References Cited

U.S. PATENT DOCUMENTS

| | | | |
|---|---|---|---|
| 2,399,523 | 4/1946 | Van Atta et al. | 102/417 |
| 2,881,702 | 4/1959 | Glennon et al. | 102/417 |
| 3,010,395 | 11/1961 | Maltby | 102/417 |

*Primary Examiner*—Stephen C. Bentley

*Attorney, Agent, or Firm*—Kenneth E. Walden

[57] ABSTRACT

A control system for a magentic submarine mine adapted to be fired automatically upon the approach of a vessel and in which the possibility of premature detonation of the mine by a minesweeper is substantially reduced. For example, some of the magnetic mines being laid in a particular mine field may be set so that after several actuations by a minesweeper a few of the mines will be exploded, the remaining mine field requiring a larger number of signals before detonation. By varying the number of signals before a mine is detonated the particular mine field after being swept is still considered lethal because many of the mines are left in the armed condition and others awaiting to be armed by subsequent minesweeping or the passage of vessels, as the case may be.

10 Claims, 18 Drawing Sheets

MARINE MINE FIRE CONTROL MECHANISM

This invention relates to the control system of a submarine mine adapted to be fired automatically upon the approach of a vessel and in which the possibility of premature detonation of the mine by a minesweeper is substantially reduced. More specifically, the invention relates to an arming device for rendering mines in an armed state in accordance with a preset cycle and accounting operation.

Devices of this character heretofore proposed for guarding a mine against detonation by minesweepers generally comprise rather delicate electromagnetic operating switching devices for controlling the arming of the mine which generally depend upon counting the number of signals necessary to place a mine in an armed condition. By repeated sweeping operation, the prior art control mechanism would usually operate and detonate the mine before the intended target was in the area.

Applicants have a control device in which the actuation signal may be varied from a small number to a large number. For example, some of the mines being laid in a particular mine field may be set so that after several actuations by a minesweeper a few of the mines will be exploded, the remaining mine field requiring a larger number of signals before detonation. By varying the number of signals before a mine is detonated the particular mine field after being swept is still considered lethal because many of the mines are left in the armed condition and others awaiting to be armed by subsequent minesweeping or the passage of vessels, as the case may be.

One of the objects of the present invention is the provision of new and improved means for causing the mine to fire in response to a predetermined number of vessels passing the mine.

Another object is the provision of a control that may be set at any arbitrary number for delaying the arming of the mine until a predetermined number of detecting signals have been received in a predetermined time spaced relation.

Another object is to provide new and improved means for rendering the mine unresponsive to additional signals if received within a predetermined time interval after the initial signal has been received.

Another object is to provide a new and improved firing control mechanism which is economical to manufacture, reliable in operation, and which is considered safe for storage and handling.

Still another object is to provide a new and improved control means for a mine that may be easily set and visually checked.

Other objects and the entire scope of the invention will become further apparent in the following detailed description and in the appended claims. The accompanying drawings display the general construction and operational principles of the invention; and it is to be understood, however, that said drawings are furnished only by way of illustration and not in limitation thereof and in which:

Figure 1:
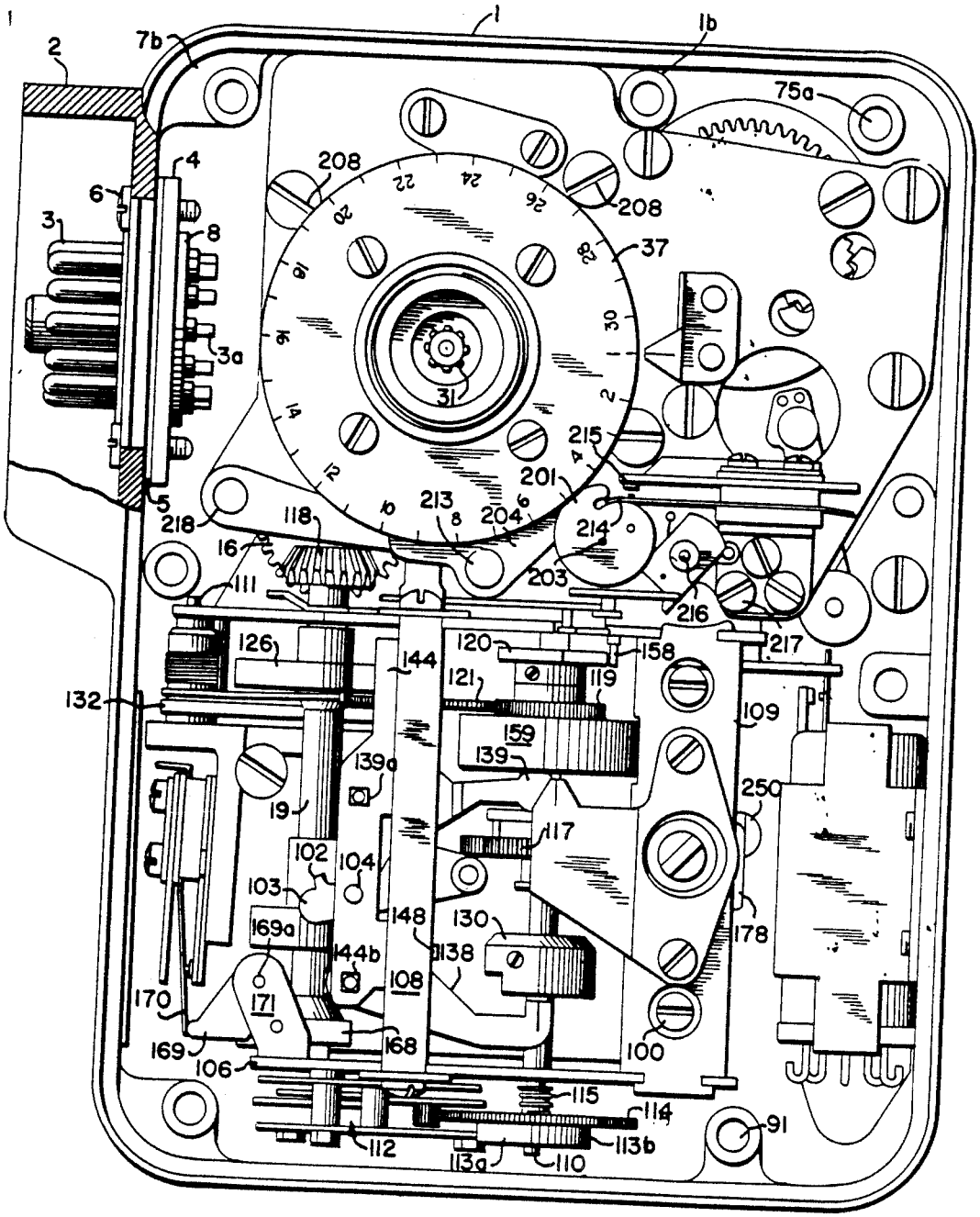
FIG. 1 is a diagrammatic view of the control assembly with the cover removed.
Figure 4:
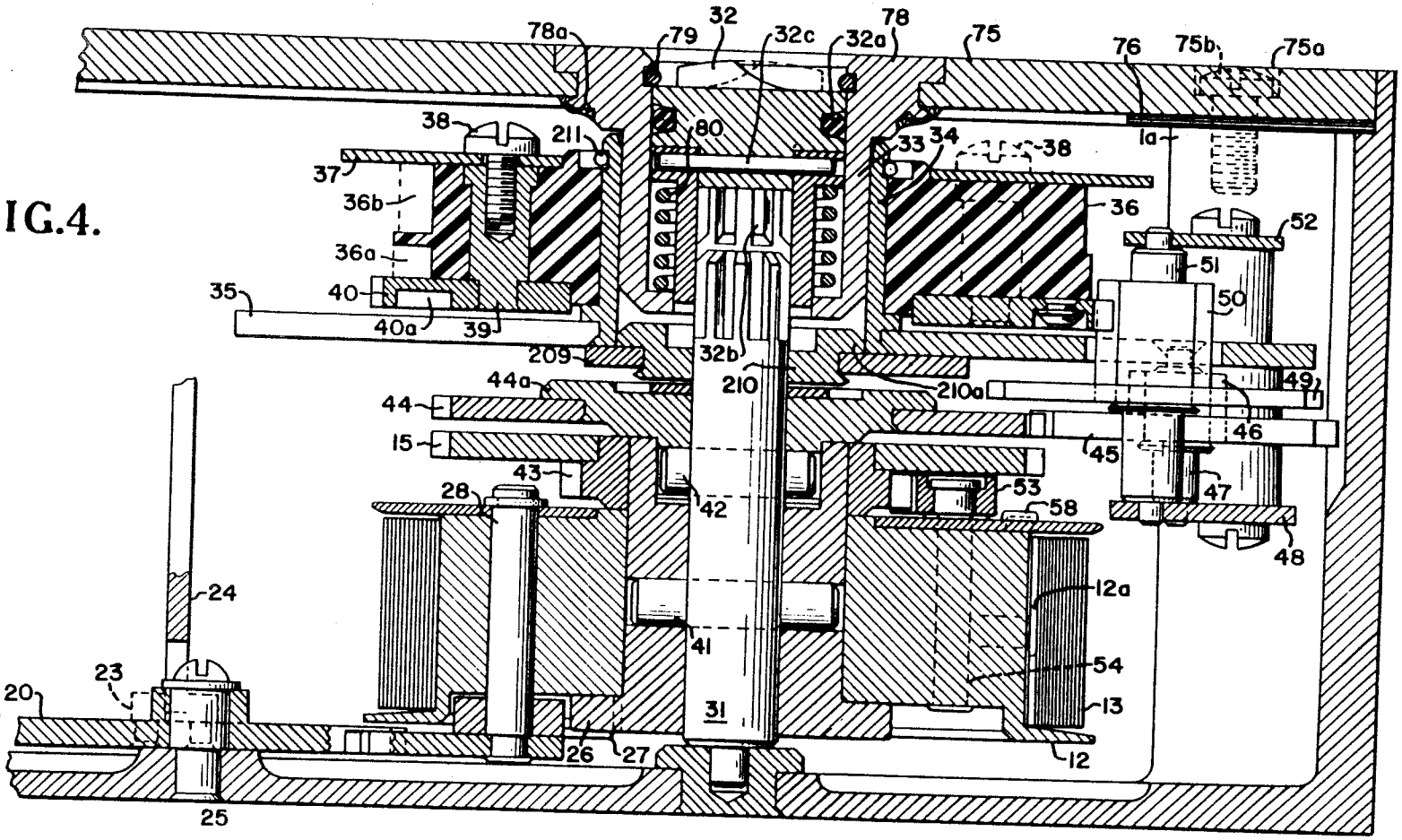
Figure 4A:
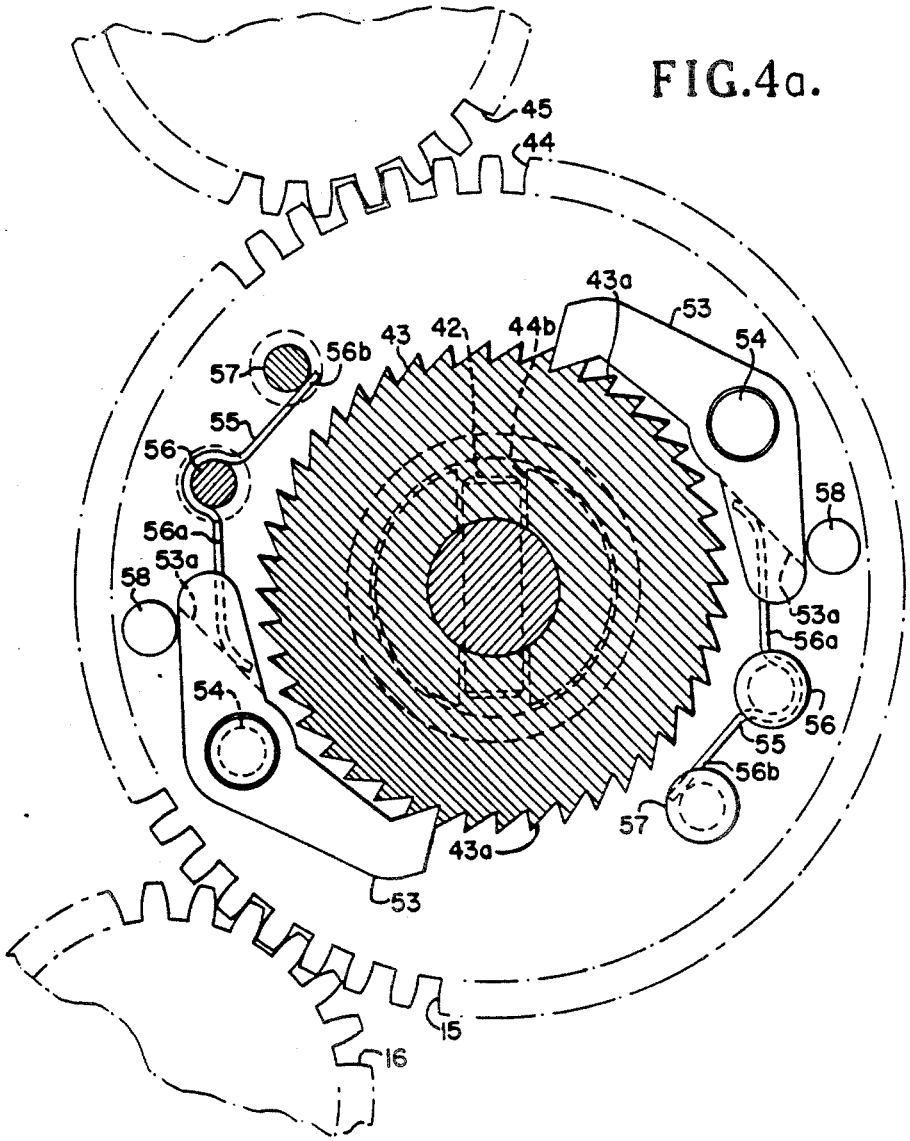
Figure 14:
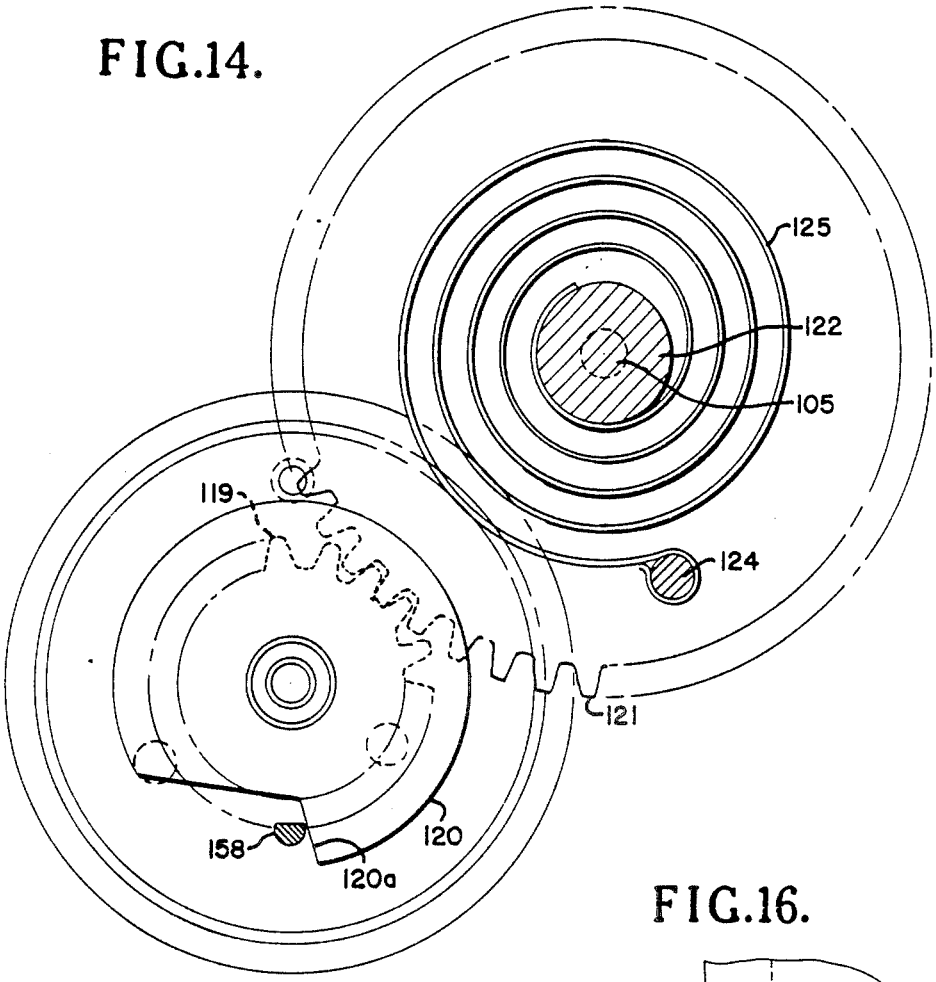
Figure 16:
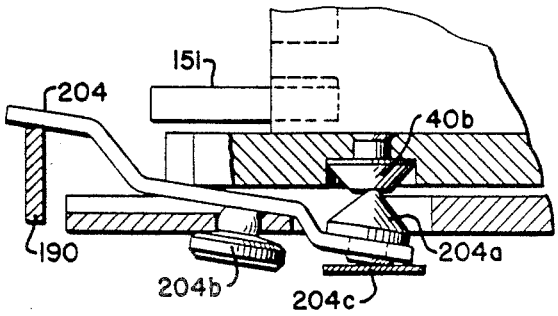
Figure 5:
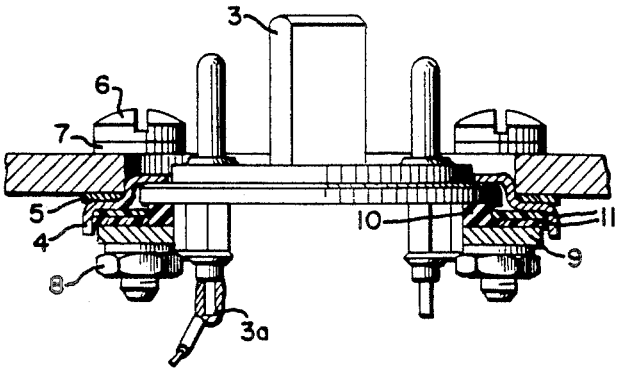
Figure 28:
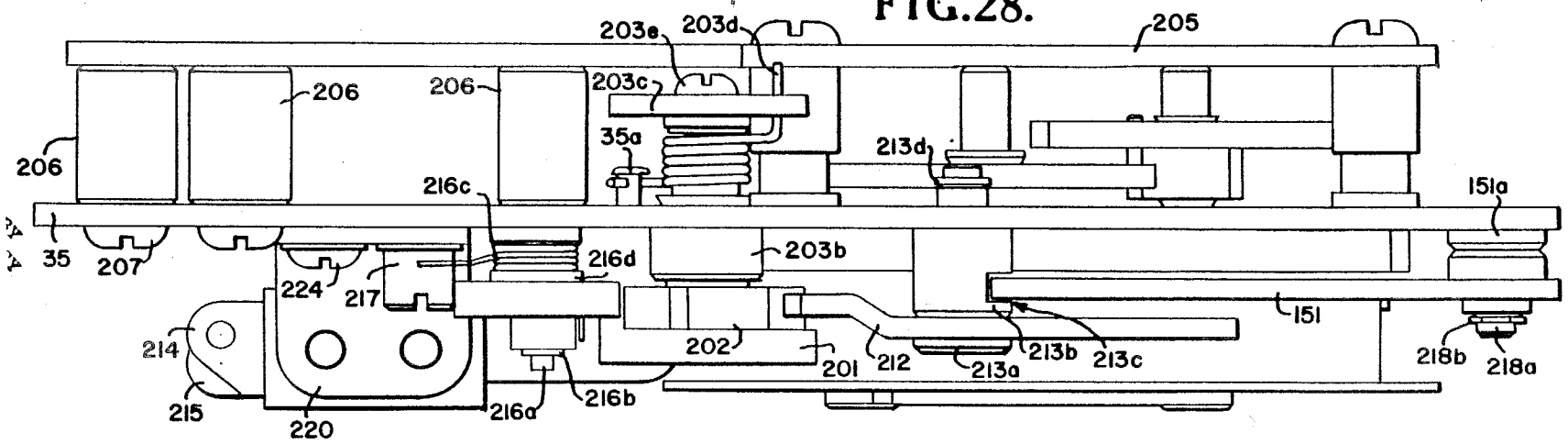
Figure 6:
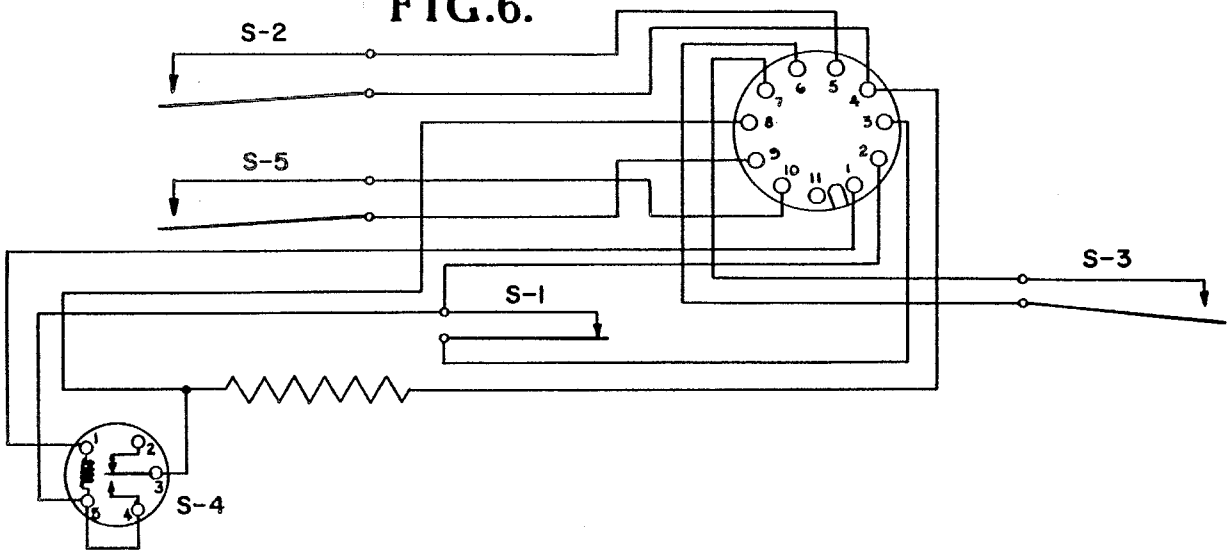
Figure 13:
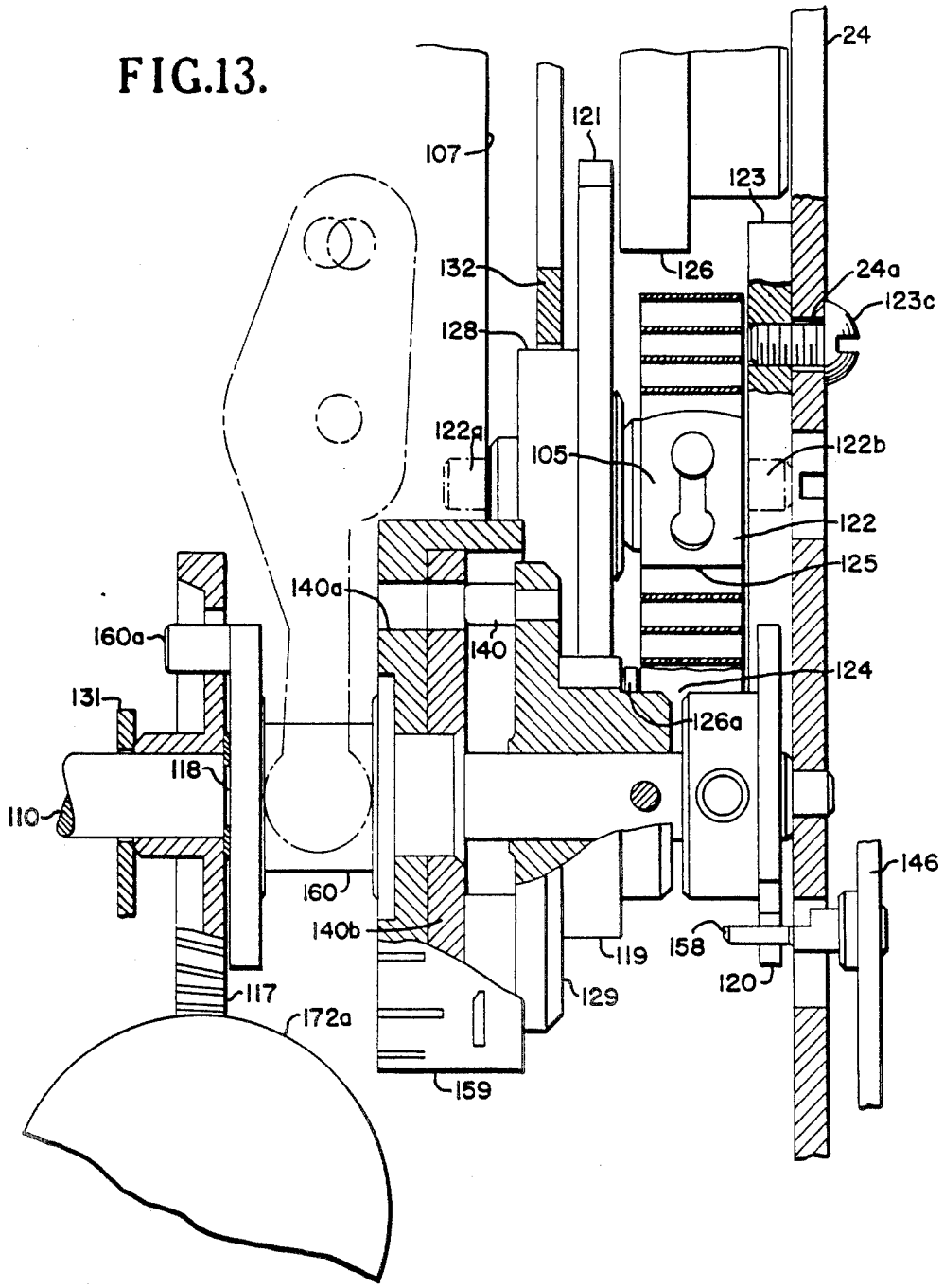
Figure 15:
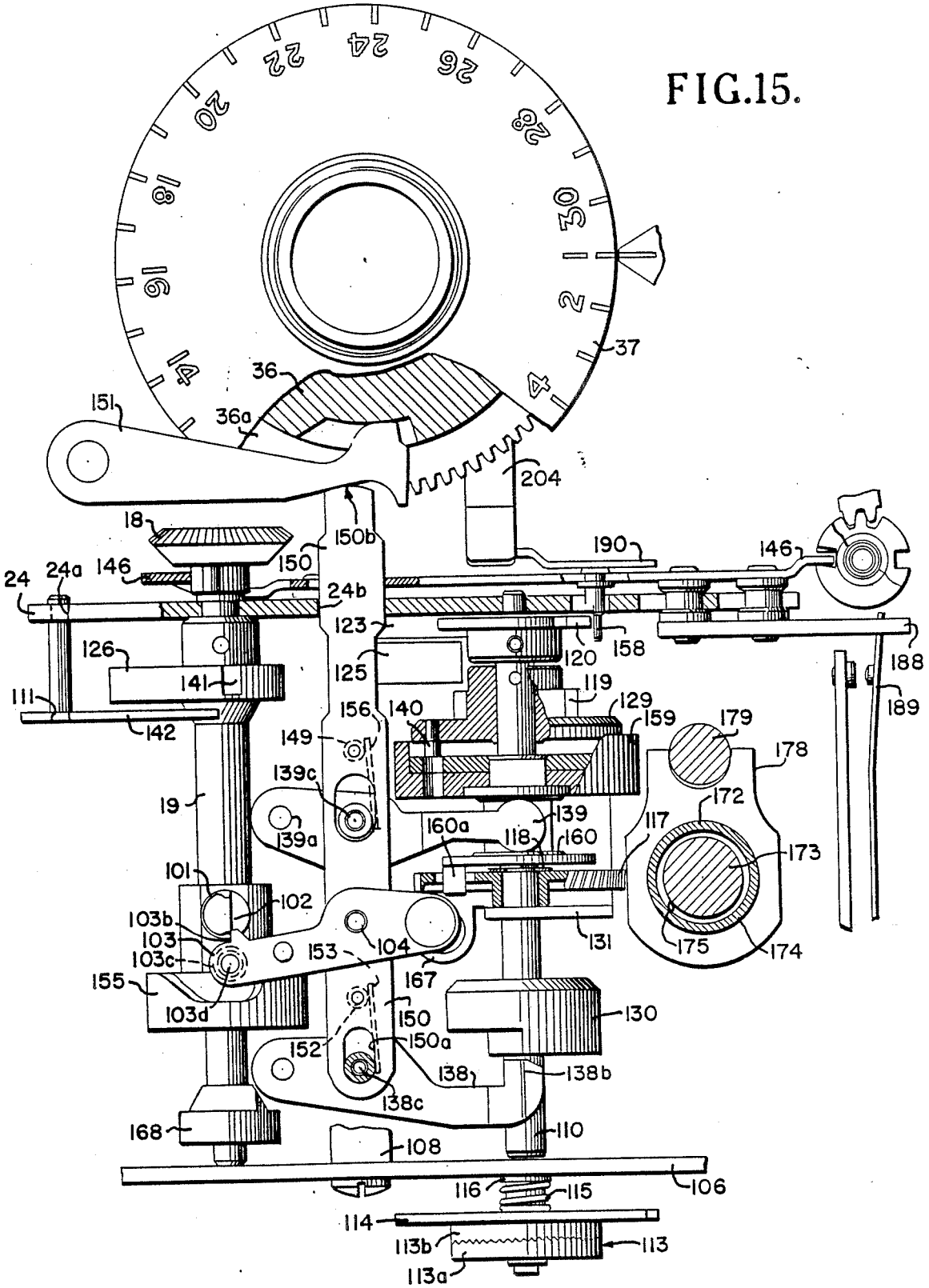
Figures 17, 19, 20:
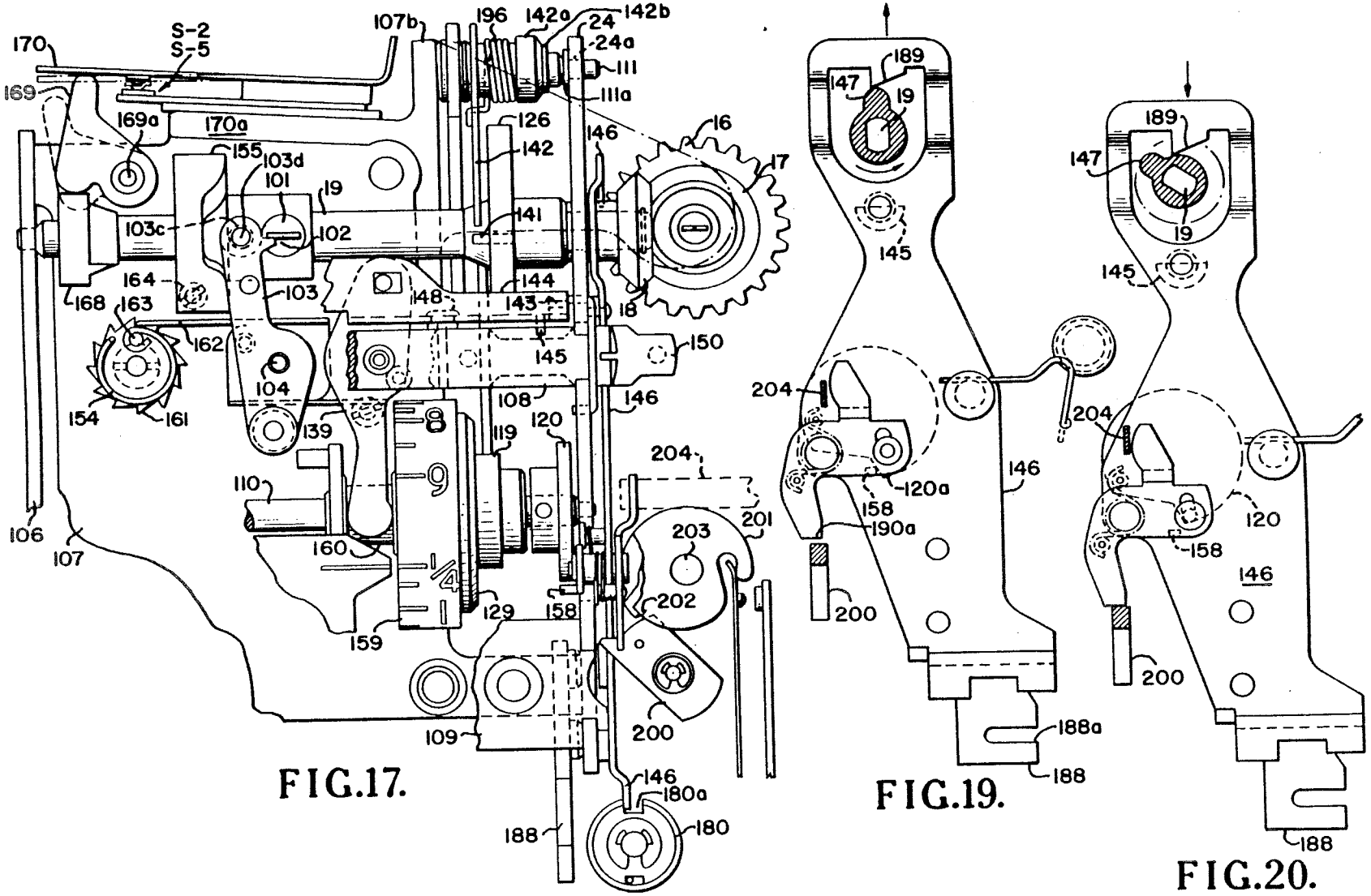
Figure 29:
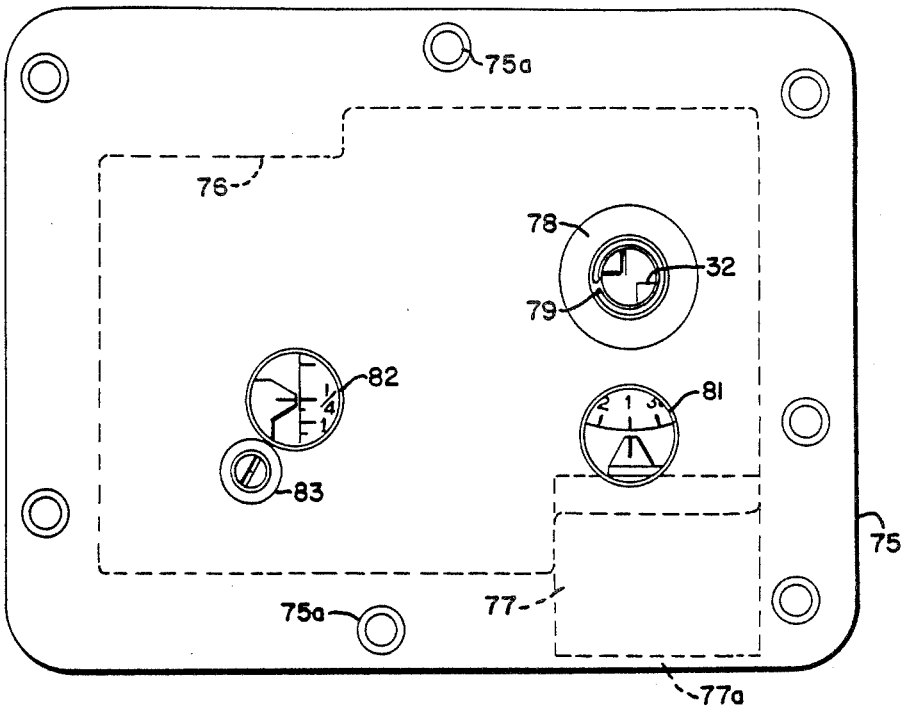
Figure 21:
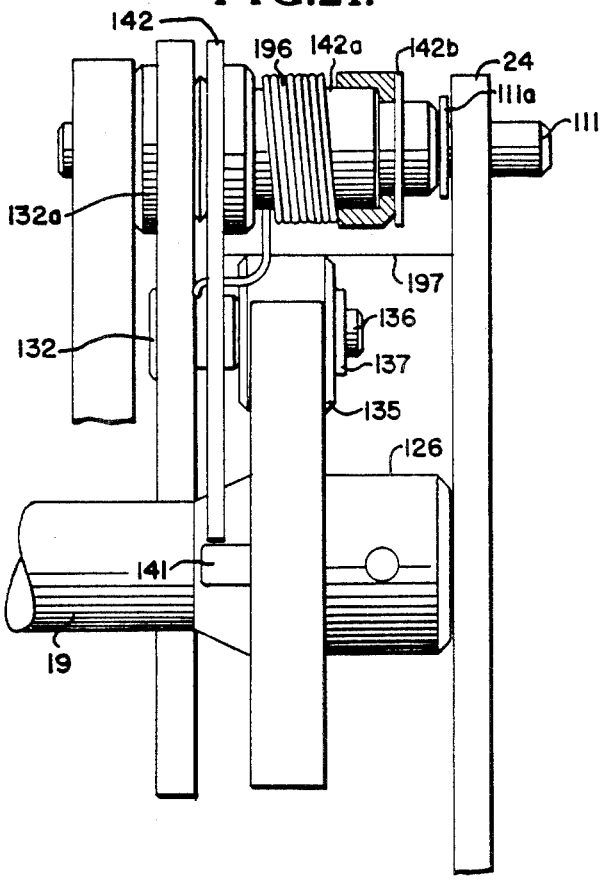
Figure 26:
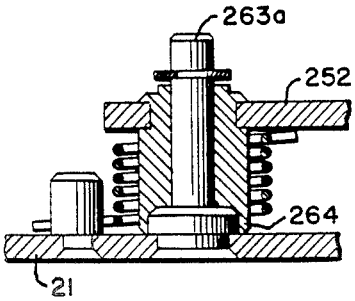
Figure 22:
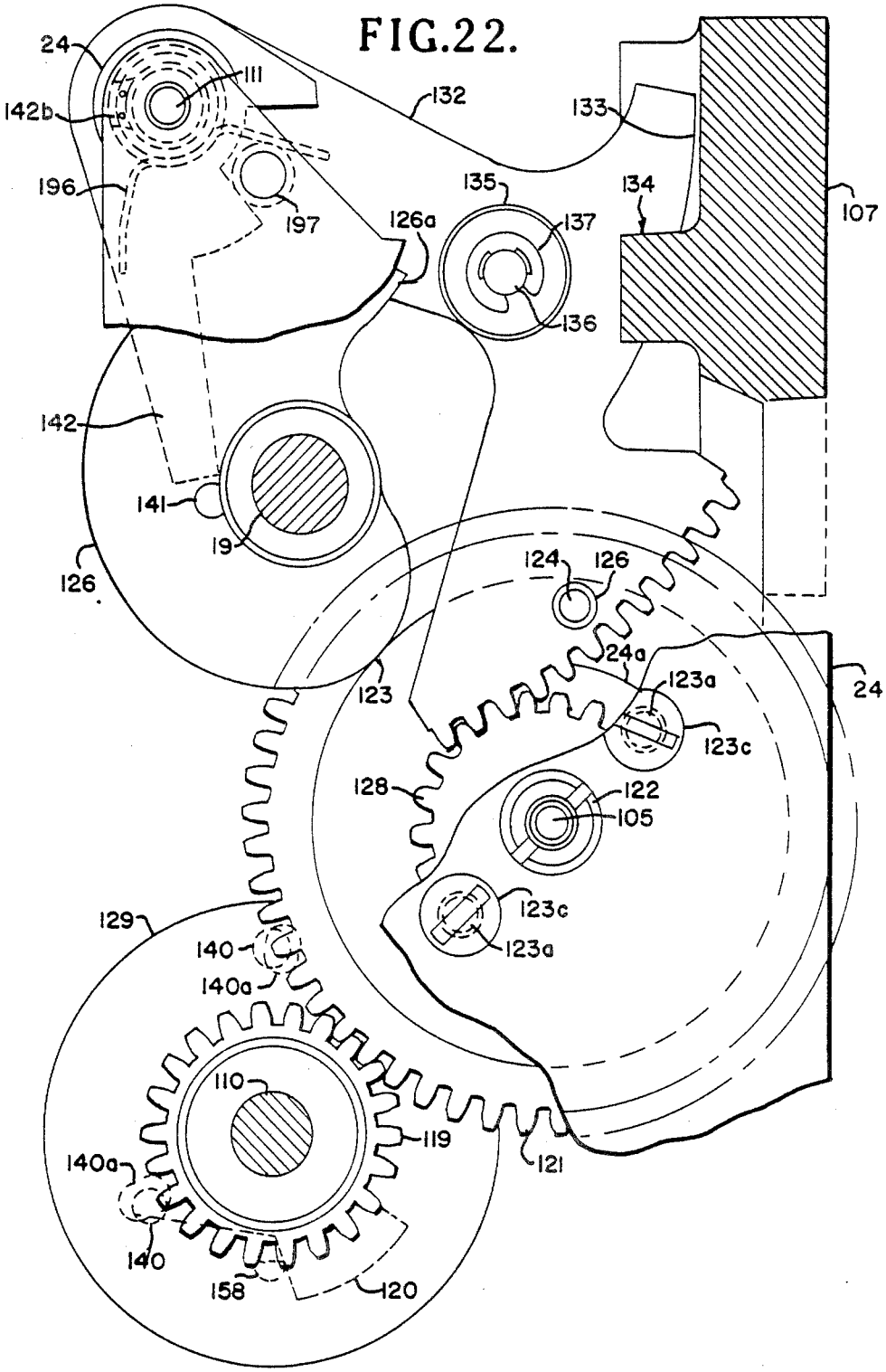
Figure 27:
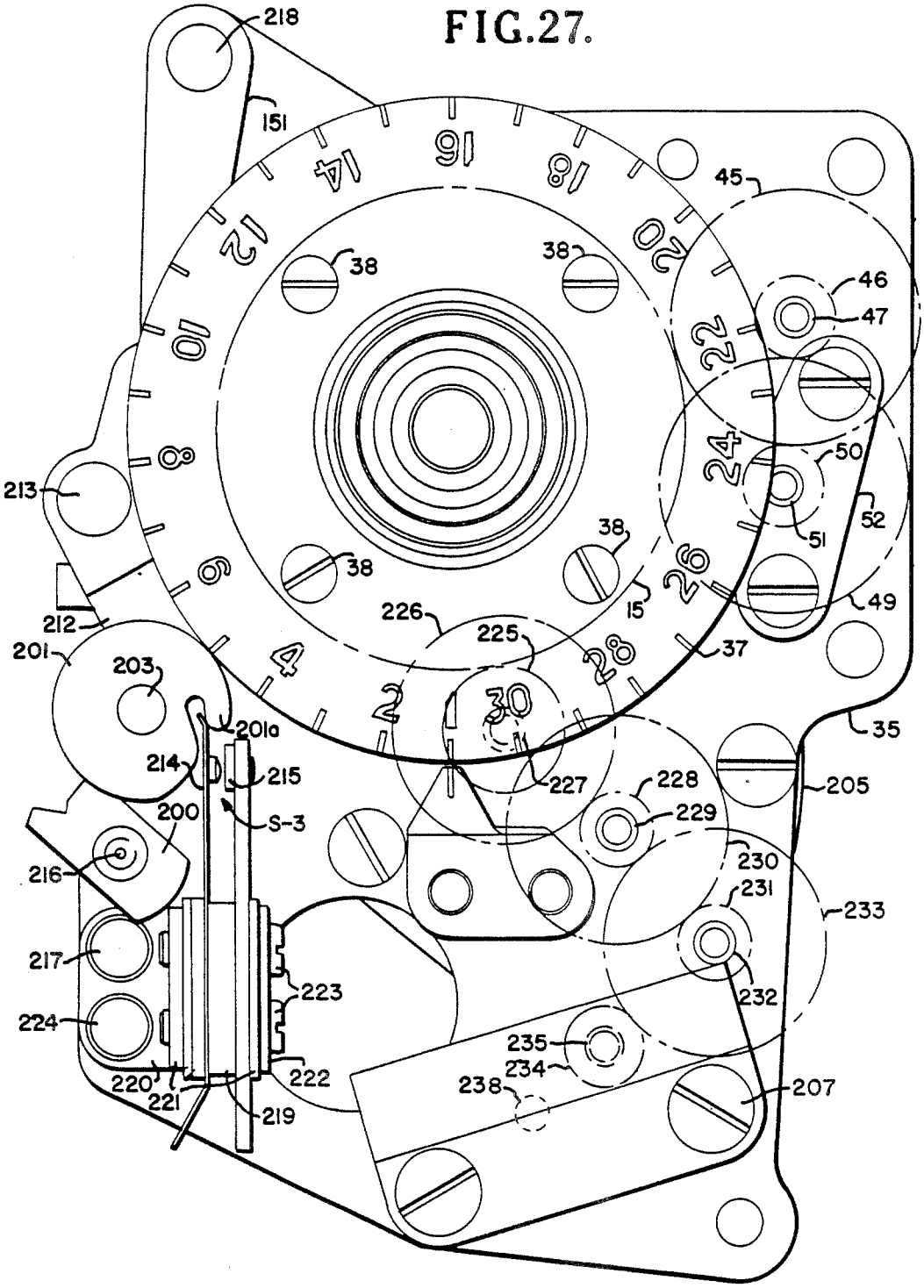
Figure 31:
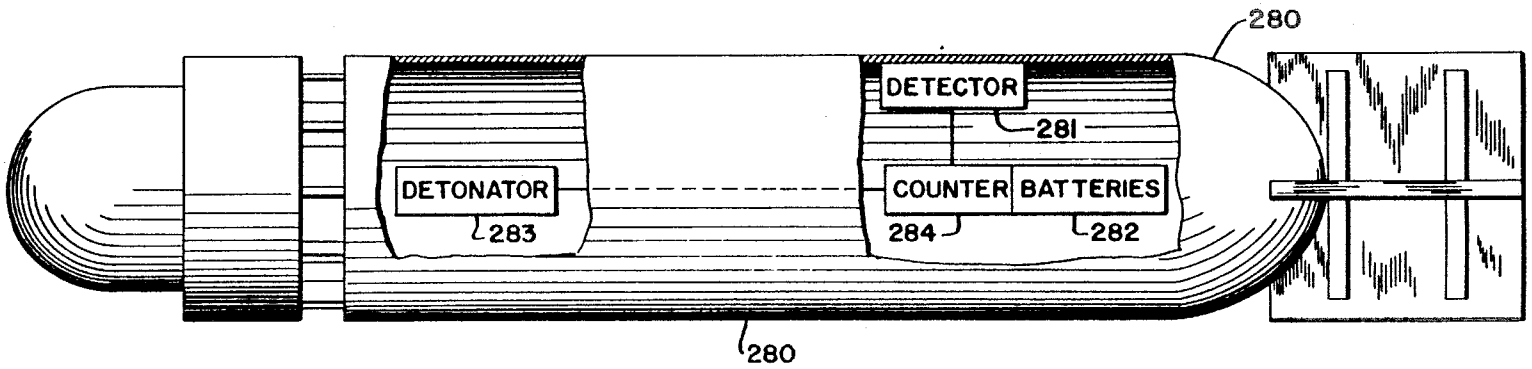
Figure 30:
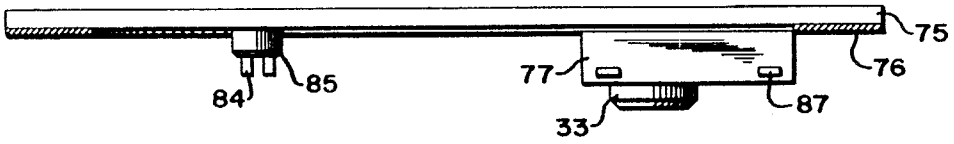

FIGS. 4, 4*a* and 5 are cross section views of the control cam and operating mechanism of FIG. 1;

FIG. 6 is a schematic wiring diagram of the control mechanism;

FIGS. 7 through 12 are detail sectional views of the control unit assembly of FIG. 1;

FIGS. 13 and 14 are detail sectional views disclosing the operational details of the control unit of FIG. 1;

FIGS. 15 and 16 are detail views of the control and dial units of FIG. 1;

FIGS. 17 though 20 illustrate the details of the initiator slide mechanism;

FIGS. 21 and 22 illustrate the details of the timing spring winding and adjusting mechanism;

FIGS. 23 through 26 illustrate the operation details of the initiator unit assembly;

FIGS. 27 and 28 illustrate the details of the dial unit assembly;

FIGS. 29 and 30 are detailed views of the cover assembly to be utilized on FIG. 1; and FIG. 31 is a view in section of a mine employing the device of the present invention.

Referring first to FIG. 31 of the drawings there is shown a mine partially in section thereon disposed in a body of water and indicated generally by the number 280 within which is disposed a detecting mechanism 281 responsive to a disturbance in the terestial magnetic field adjacent the mine and for sending out electrical pulses. The source of power 282 is connected to the detonator 283 by an actuation counter 284 which is more fully described hereinafter.

The actuation counter as shown in FIG. 1 is hand wound and set, spring driven and electrically pulsed to repeatedly initiate, perform and conclude a preset cyclic timing and counting function, the operating cycle being mutually dependent, interrelated and sequentially phased to close or open five contacts during its run, which includes the intervening time delay interval, one contact remaining unaffected and in open state during the cycling operation until the last initiating pulse has been transmitted to the counter.

There is a "dead period" between the initiating pulse and the end of each operational cycle. The dead periods for all counts from 30 through 3 are fixed to cause a delay of 5 minutes. The last dead period which occurs when the ship count dial is set on 2 is variable and selected to deliver a time delay of ¼ to 9 minutes.

The actuation counter is used with and controlled by the operation of other devices and can be preset to cycle a maximum of thirty times with recycling time delay five minutes for single trip actuation from the maximum or any intermediate count down to count number 2. Each count is a full cycle and the dial indicating the count is deleted one position at each cycling operation. During actuation of each of the five minute intermediate dead periods, the switch S3 remains open and is physically prevented from closing, accidentally or otherwise, by certain safeguards that will be described in detail hereinafter. Each count cycle must be seperately initiated.

Upon reaching count number 3 on the indicating ship count dial, the device is made ready to transfer the dead period control from the intermediate phase of five minute intervals to the last phase of the preselected interval, so that upon initiating the cycle of count number 3 the transfer mechanism comes into play to switch the interval control from the intermediate to the last dead period during the deletion of the dial count down to count number 2.

Count number 2 of the indicating ship count dial is designed to have a dead period interval from ¼ minute to 9 minutes, depending on the selection previously made. Whatever the selection, indication of the selection may be had by visual observation through a small circular window in the cover of the device. A similar window beneath the count dial permits viewing the ship counting settings.

Referring now particularly to FIG. 6, there is shown thereon the schematic wiring diagram, which illustrates the connections within the housing between the contacts, initiator and the terminal connector pins. Relative to the functional operation, the contacts have the following timing. At the beginning of each cycle, switch S-1 is closed and switches S-2, S-3, S-4 and S-5 are open. Switch S-1 remains closed during the initiation period and is opened within 2.5 seconds after completion of the operation of the initiator for every actuation. Switch S-1 remains open for 5 minutes for all the actuations from 30 to number 3. If the last dead period is set from 1 to 9 minutes, switch S-1 remains open for a period equal to the dead period in minutes plus or minus 30 seconds. If the last dead period is set for ¼ or ½ minute, switch S-1 remains open for the said time plus or minus 5 seconds; however switch S-1 will close at the end of every dead period.

Switch S-3 remains open throughout all winding cycles, except on the ship setting dial if set on the number 1 count. Switch S-3 then closes within 0.5 seconds after the proper voltage is applied to pins 1, 3 and 4.

Relay switch S-4 closes for every actuation when 12 volts dc is applied to pins 1 and 3. The switch opens when the voltage is removed.

Switches S-2 and S-5 are mutually independent, and close from 3 to 6 seconds before the closure of switch S-1 at the end of the dead period, and remain closed for a period of 1 to 3 seconds.

The actuation counter has been designed in such a manner to accomplish the operational order as recited. In order to facilitate the wiring, adjusting and assembly, the device has been designated so as that the assembly consists of interrelated groups of separate functional assemblies, numbering 5 units. Each functional unit will be described separately and its interdependence in a functional manner upon other units will be described hereinafter recited.

The counter is designed to be antimagnetic and the mechanism of the counter is housed in an aluminum case and supplied with a cover of similar material. The casing is both dust proof and moisture tight. There are two openings in the cover, by means of which the selective settings of the ship count and last dead period are accomplished. These openings have stems suitably end formed, disposed therein to permit turning by means of a screwdriver and the stems are each provided with O-rings and cover bushings to exclude dust and moisture. These stems do not move during actuation and cycling. The slot formed in the dead period setting stem is of the nature to permit limited turning in either direction. The setting is indicated by means of a pointer designed close to and in the same horizontal plane as the indicia on the interval drum in order to lessen the effect of parallax. Any setting made of the dead period interval from the case exterior will remain locked in that setting due to the use of a worm and worm wheel transmission. Further, vibration and shock effects will not change the setting due to the resiliency offered by the "O" ring construction and the symmetry of the parts. The slot formed in the ship count dial setting stem is of the nature to permit unlimited turning, but in a clockwise direction only. The setting is indicated by means of a pointer and the ship count dial which are arranged to minimize parallax effects. Any setting of the ship count dial also results in co-incidential winding of the "flat gradient" power spring by an equal amount to the restoring couple required of that particular chosen setting. In other words, for example, if the ship count dial is set at number 18 count, the power spring is wound at the same time an amount sufficient to run down the count from number 18 to origina count number 1. In the actuation counter being described, the ratio of input to one ship count dial interval is 0.5/30.0, so that ½ turn of the setting stem is required to move the dial one count space. The ratio of power stored as against delivery in terms of spring turns is 1:2, so that for each cycle the spring uncoils ½ revolution for one complete revolution of the control unit cam shaft.

Inasmuch as the spring is calculated to deliver a torque on the operating drum of approximately 2.5 inch pounds, and approximately 0.5 inch pound of this is dissipated in operation of the governor on the Dial Unit through the governor train of gears which includes allowances for friction, the remainder of 2 inch pounds torque is transmitted at the ratio of $0.8 \times 2/2$ through the control cam shaft. Thus the shaft possesses a potential torsional movement of 0.8 inch pounds for the following duties performed in a cycle of one single revolution enumerated sequentially as follows:

A. Closes switches S-2 and S-5 and simultaneously therewith cams out trip arms to free interval actuators;

B. Winds timing springs an amount equal to run down;

C. Retracts initiator slide, permitting latching by initiator;

D. Closes and opens switches S-2 and S-5;

E. Closes switch S-1;

F. Stops overrun of timing shaft.

Referring again to the setting and co-incidental windings of ship count dial and spring, the stem is a part made in the form of a self-releasing spline clutch. After placing the screwdriver blade in the one way slot, the operator depresses the stem in order to connect with the winding arbor splines and while holding the stem down in this position against the bias of the spring, turns the screwdriver clockwise to effect the desired setting. When this is accomplished, the operator removes the screwdriver and the biasing spring declutches the system from the arbor. The ship count dial system is capable of being turned in a clockwise direction without limit as to the number of turns. The mechanism to accomplish this will be described in more complete detail later. Thus if the operator has made an error in the setting, he is required to continue turning the screwdriver until the dial pointer and the correct indication coincide. In doing this, he may make more than one revolution of the dial, but will neither damage the spring nor unhook it from the operating drum or unwind it from the storage bushing. This feature makes it unnecessary to run down or cycle the counter to a lower setting, which can only be done by applying power to the pins 1, 3 and 4.

Refer specifically now to the drawings of FIGS. 1 through 5, showing the housing unit, wherein FIG. 1 is a plan view of the counter shown with the cover removed. The case 1 is a die casting of a light non-magnetic material such as magnesium and is formed with bosses "1*a*" and projection "1*b*" to which the other four main units are fastened. A shield 2 also formed on one side, which fences in on three sides the connector 3. The connector 3 of FIG. 1 consists of an 11 pin type terminal connector 3, cap 4, gasket 5, four screws 6, and sealing washers 7 and nut 8. FIG. 5 illustrates plate 9, inner ring of silicone rubber 10, and gaskets 11 of the connector.

As assembled, the connector mounting forms a dust and watertight construction and by the unique attachment method, is possible to remove the connector 3 from the housing 1 without disconnecting the attached wires to the pin terminal 3*a*.

Figure 2:
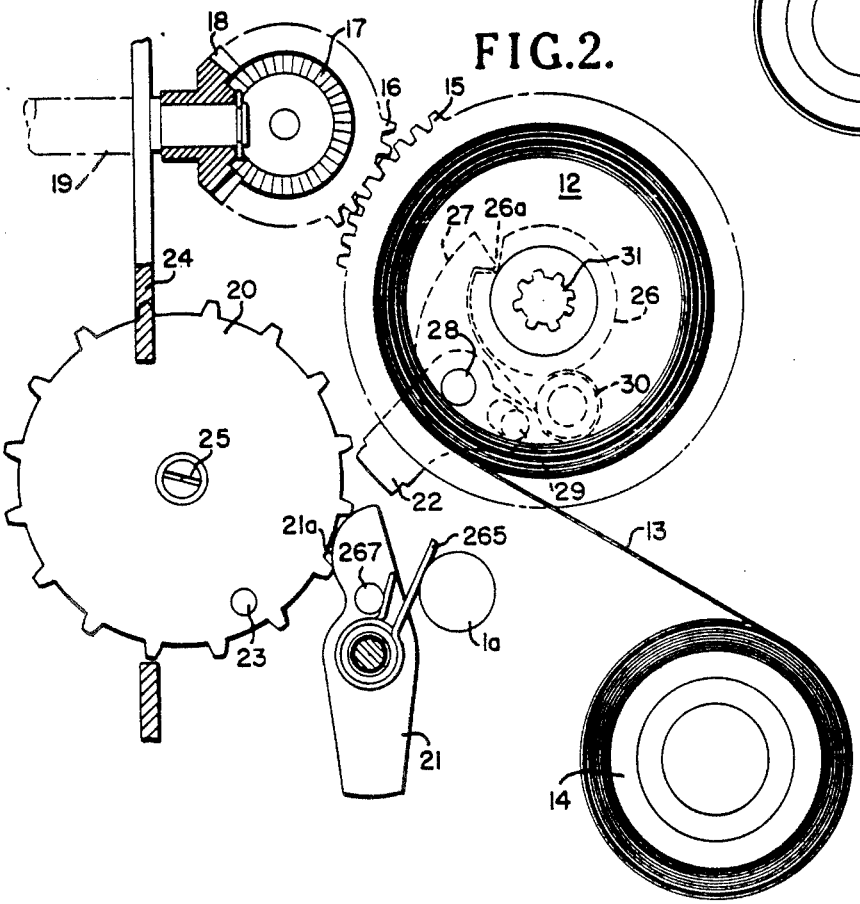
FIG. 2 is a detailed sectional view of FIG. 1 disclosing the power drive for the control dial units.

FIG. 2 shows the spring motor in plan view, consisting of operating drum 12, power spring 13, and storage bushing 14. The spring is hooked to stud not shown, in the drum.

The transmission of the power from the operating drum 12 is achieved by means of gears 15 and 16, and miter gears 17 and 18, the latter three being rotatably mounted on the control unit assembly, gear 18 being attached to shaft 19 of the control unit assembly.

FIG. 2 also shows the means for counting to and limiting the maximum number of turns of spring 13 put on the drum 12. This consists of a count wheel 20 having 16 "teeth" or projections on its rim, and the click pawl 21 which positions wheel 20 after each turn of the drum 12 relative to the count lug 22. The lug 22 is shown in full lines to be in rest position after all even number counts have been selected or cycled; it is shown in dashed outlined to be in rest position 180° from the "even" rest position for all uneven numbered counts. The count wheel is pivotally mounted at 25 in the case bottom.

Figure 3:
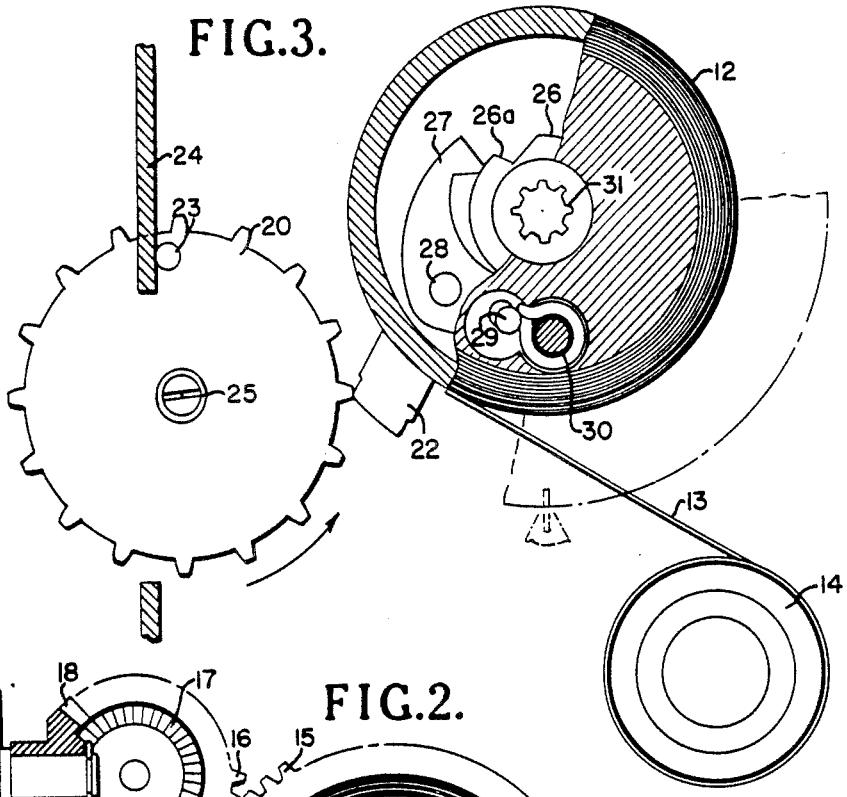
FIG. 3 is a detailed sectional view disclosing the winding release and counting mechanism of FIG. 1.

The count wheel 20 carries a pin 23 which turns with the count wheel and jams against either the inside or outside surface of the control unit plate 24. The pin 23 has a diameter such that in conjunction with its radial distance from the axis 25, thickness of plate 24 and the location of the axis 25 in relation to plate 24, if it were to contact plate 24 hypothetically on both the inside and outside surfaces at once, the angular displacement between the centers and the axis 25 would amount to one "tooth" space of the rim of the count wheel 20. Although the count wheel 20 has 16 "teeth", it will revolve a total of only 15/16th of the turn, and it requires a full turn of the drum 12 to actuate the count wheel 1/16 turn. It follows that no more than 15 full turns of spring 13 are allotted to drum 12. Because the operating cycle uncoils ½ turn, the total ship count is 30. FIG. 3 shows the means for disconnecting the winding arbor 31 if winding and setting is continued after the maximum of 15 turns has been placed on drum 12. These consist of notched cam-flange 26, hook 27, shaft 28, tail pin 29, spring 30 and lug 22. These parts are mounted to and cooperate with the drum 12. Referring to FIG. 3, where continued turning of the winding setting stem will result in a fully wound spring 13 on the operating drum and pin 23 against the outer surface of plate 24, being thrust and held thus by lug 22 acting through one of the "teeth" of count wheel 20. Further turning of the drum moves to shaft axis 28 a small angular amount and by means of pin 29 in lug 22, transfers the equivalent motion by means of the notch and hook 27 to the latter and against the bias of spring 30. This movement retracts hook 27 from engagement with notch 26*a* in cam-flange 26 of the arbor 31 and continued turning of the setting stem and arbor 31 results in merely changing the ship counting dial indication, so that it is possible to correct setting errors or operate the device at any ship count with a fully wound spring.

FIG. 4 is a cross sectional elevation of the winding and setting arbor 31, and also operating drum 12 and control cam 36 are shown, which clearly illustrates the axial coincidence of the parts relative to the arbor 31 and the stem 32, the latter being carried in the cover unit.

The device is designed to make the winding and setting axis the "locating point" for assembly of the cover unit to the housing unit in order to obtain correct functional alignment. A reduced diameter of the cover bushing 33 is made to enter into socket bushing 34 with a minimum amount of clearance. Socket 34 is fastened to plate 35 of the dial unit.

The construction of this unit is such that the effects of heavy shocks are transferred to the rigid cover and housing under direction of the primary and secondary shock waves. Moreover, lateral effects are offset wherever possible by the symmetrical placement of parts or by dynamic component balancing in a plane perpendicular to the related axis of the parts and in other instances, by confining or limiting the amplitude so that the elastic limits of the parts concerned are not exceeded by reason of the shock waves.

The weight of the components has been minimized to a great extent by the use of aluminum in their construction, which reduces inertial effects. FIG. 4 also illustrates the means employed for driving the ship count dial 37, which is fastened to cam 36 through an agency of four screws 38 threaded into studs 39 that are riveted into dial gear 40 to form a holding means in the assembly 36 and 40. The cam may be made of any material suitable for the purpose such as for example, nylon. An annular groove 40*a* is shown formed in gear 40 and at a certain point, relative to the dial indicia number 1, a truncated conical headed pin 40*b* is mounted in the groove 40*a*. Before describing the function of pin 40*b*, it will be best to refer to the dial driving or coincidental dial turning and winding means.

Winding arbor 31 is equipped with two keying pins as shown at 41 and 42. Pin 41 is driven through both the arbor 31 and flange bushing 26, the latter being made of Aluminum or the like for strength. Pin 42 is driven through the arbor 31 and extends through the arbor a small amount on either side to form the driving key for the hub 44*a* fastened to the dial drive gear 44. This is done purely for assembly reasons. As shown in FIG. 4*a*, the hub 44*a* of the dial drive gear 44 is cross milled as shown at 44*b*, to encompass pin 42 so that these parts ar turned in unison with arbor 31. Gear 44 meshes with gear 4 the latter being stacked and pinned to pinion 46. Pinion 46 is integral with shaft 47 and pivoted in plates 35 and 48. Pinion 46 meshes with intermediate gear 49. Gear 49 is stacked to pinion 50 which is integral with shaft 51 and pivoted in plates 52 and 48. Pinion 50 meshes with gear 40.

The dial drive ratio is such that a one-half turn of the spring drum 12, with winding or running, results in 1/30 turn of dial 37 and consequently of cam 36. The fastening holes in the dial 37 are sufficiently larger than the screws disposed therein in order to enable a close calibration of the dial.

FIGS. 4 and 4*a* illustrate the one-way drive mechanism of the control unit transmitted through the gear 15. This gear is fastened to ratchet wheel 43, which is mounted axially to revolve on flange bushing 26. Two diametrically opposite sets of pawls 53, pivoted on pins 54 are held in engagement with oppositely aligned teeth 43*a* on ratchet wheel 43, springs 55 are wound around studs 56 and each have one leg 56*a* pressing against the bottom of the groove in pawls 53 as shown at 53*a*, and have the other leg 56*b* thereof resting against the inter cylindrical surface of two pins 57. Thus pawls 53 are biased inwardly at the teeth 43*a* and remain thus during all cycling periods. Two extruded stops 58 prevent spring 55 from slipping out of the grooves 53*a* and pawls 53. Thus when winding and setting the ship count dial, the pawls 53 are carried around the drum 12 in a clockwise movement and freed of the ratchet teeth 43*a* of ratchet wheel 43, while the latter remains stationary because of the two-way stop in the control unit. The large number of teeth in the ratchet wheel offers fine spacing alignment possibilities with the dial.

Refer now to FIGS. 29 and 30 which illustrate the appearance of cover 75 when applied to housing 1, also the edge view of the cover with the projecting parts that cooperate functionally with the control unit number 3 of the housing unit number 1.

A gasket 76 is cemented to the cover 75 in order to provide dust and moisture protection, the gasket being made of a cork and rubber compound. This gasket extends to the edge of the cover 75 and encompasses the mounting screws holes 75*a* of which there are preferably a total of seven. The desiccant container 77 is riveted to the cover 75 with gasket 76 being interleaved. Thus, protection is achieved along the outer narrow strip of the cover that forms a margin between the edge of the cover and the container 77, as indicated at 77*a*.

The "one-way" winding and setting stem 32 is retained in bushing 78 by a formed snap ring 79 that fits into an annular groove in bushing 78 as shown in FIG. 4. The stem 32 is composed of three parts; the stem proper, which is end formed as stated above and also has an annular groove to form a recess for the "O" ring 32*a*; the spline socket 32*b* and the locking pin 32*c* as illustrated in FIG. 4. The biasing spring 80 is nested in a space formed by the reduced diameter of spline socket 32*b* and the inside wall of the bushing 78. The anchor thrust is against an inwardly turned shoulder of 78 and the moving thrust is against an outwardly turned shoulder on spline socket 32*b*. Thus, pressure downward on stem 32 is resisted by spring 80 and which then restores the stem when the pressure is removed. The bushing 78 is closely staked all around its inner periphery to assure a tight seal, and the stem is incapsulated with a resin compound. This construction is also used around the windows 81 and 82 and around the seam of bushing 83.

Bushing 83, as shown in FIGS. 29 and 30, is securely staked to the cover 75, flush on the outside. This carries a plug 84, that is formed on the outer end to take a medium size screwdriver, and the opposite end is slotted to loosely fit over the tag of the last dead period setting stem. Plug 84 has a groove formed to accept the step ring 85 and is thus retained. An "O" ring 86 fits into a second groove and seals parts 83 and 84 against the ingress of dust and moisture, as well as providing a slight drag on the plug 84.

The desiccant container 77 is made to receive a sealed packet of silica-gel, (color indicating); the envelope consists of a thin plastic film not impervious to moisture. A removable cover 87, perforated for approximately 30% of the effective area is used to retain the packet of the desiccant. As shown on FIG. 4, the cover 75 is set to a rabetted edge of the housing 1 and securely fastened by means of screws 75*b* threaded into projection 1*a* of housing 1. This permits potting around the cover edge with a resin compound, such as glyptal or epoxy type. The control unit as shown in FIGS. 1, 2, 7 through 22 consists of a timing and automatic selecting apparatus for transferring operations of a time cycle event from one phase to another; release mechanism which starts the time cycles; spring power to run the escapement, the spring having torque adjusting means provided; axial trip mechanisms functioning at the end of the time interval of the cycle; switch closing and reopening means; two-way stop means for the control cam shaft to be locked in a rest position subject to release only by an initiation pulse; timing spring winding means to restore only the amount of component used in the timing cycle; restoring means of the trip slide; camming out means to spring the trip arms while they are in the rest position either operational or restrictive; safety means to prevent malfunction due to shock and or vibration; turn counting or limiting means for setting the last dead period according to selection and without binding on the worn transmission threads; detonator switch actuator control pawl; trip arm individual spring torsion adjusting and locking means; declutching means for the timing shaft in retrograde movement from escapement run and the resilient mounting of a pin pallet, detached lever escapement mechanism to time the dead period intervals. FIGS. 1, 2, 7 through 22 will be used in the description of its control unit.

FIG. 1 shows the plan view of the control unit no. 3 and the plan view in relation to the dial unit, initiator and housing units and the location of the three mounting screws 100. Gear 16 of the control unit meshes with gear 15 attached to the ratchet wheel 43, (FIGS. 4 and 4*a*) and the control unit receives its drive through these gears. The full torque moment of the spring 13, transferred to the cam shaft 19 by means of gears 15, 16, 17, and 18, is held blocked by stop pin 101 resting against a step in the gear lever 103 as shown at 102 in FIGS. 1, 7, 12, 15 and 17.

Figure 7:
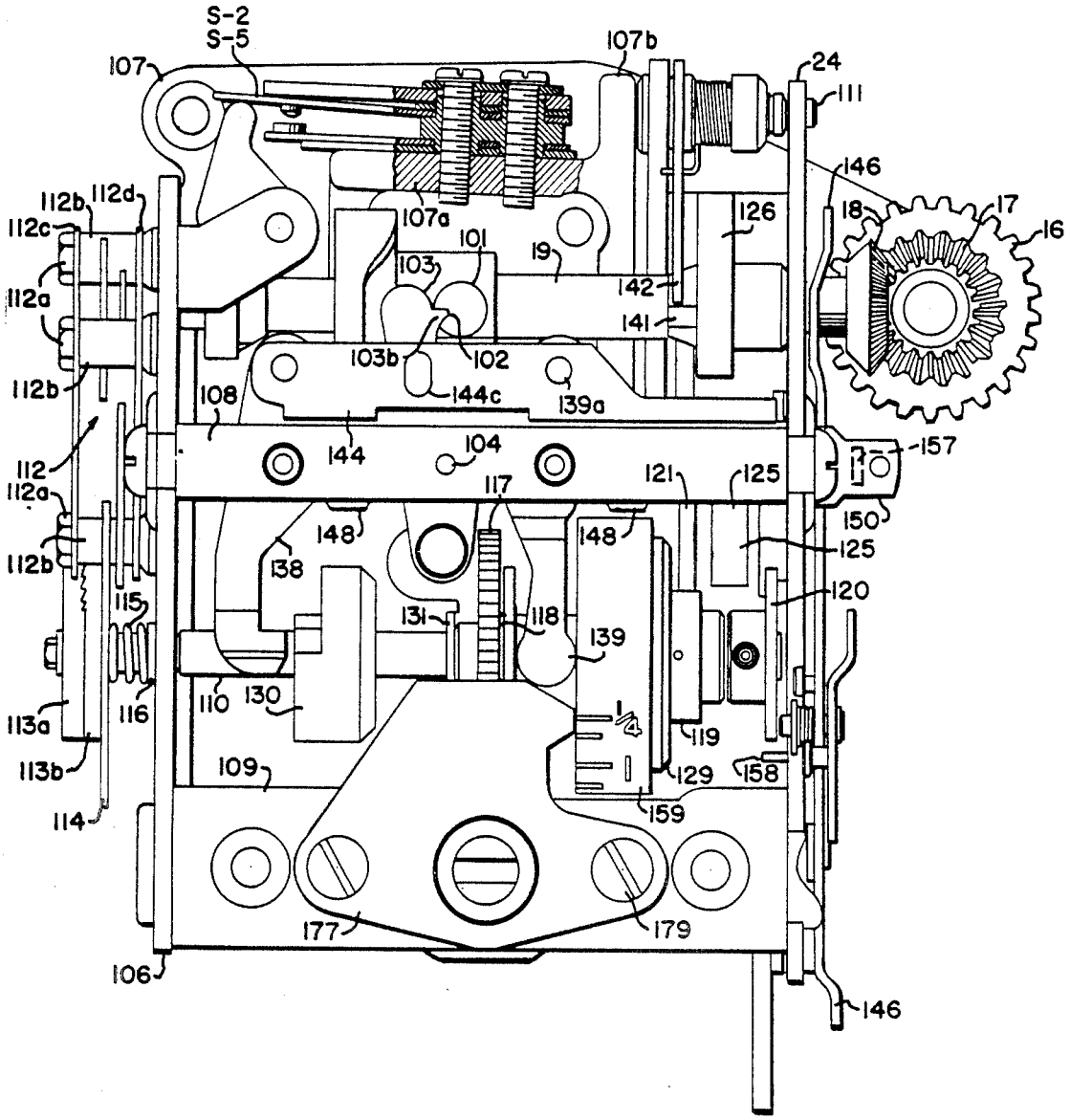
Figure 8:
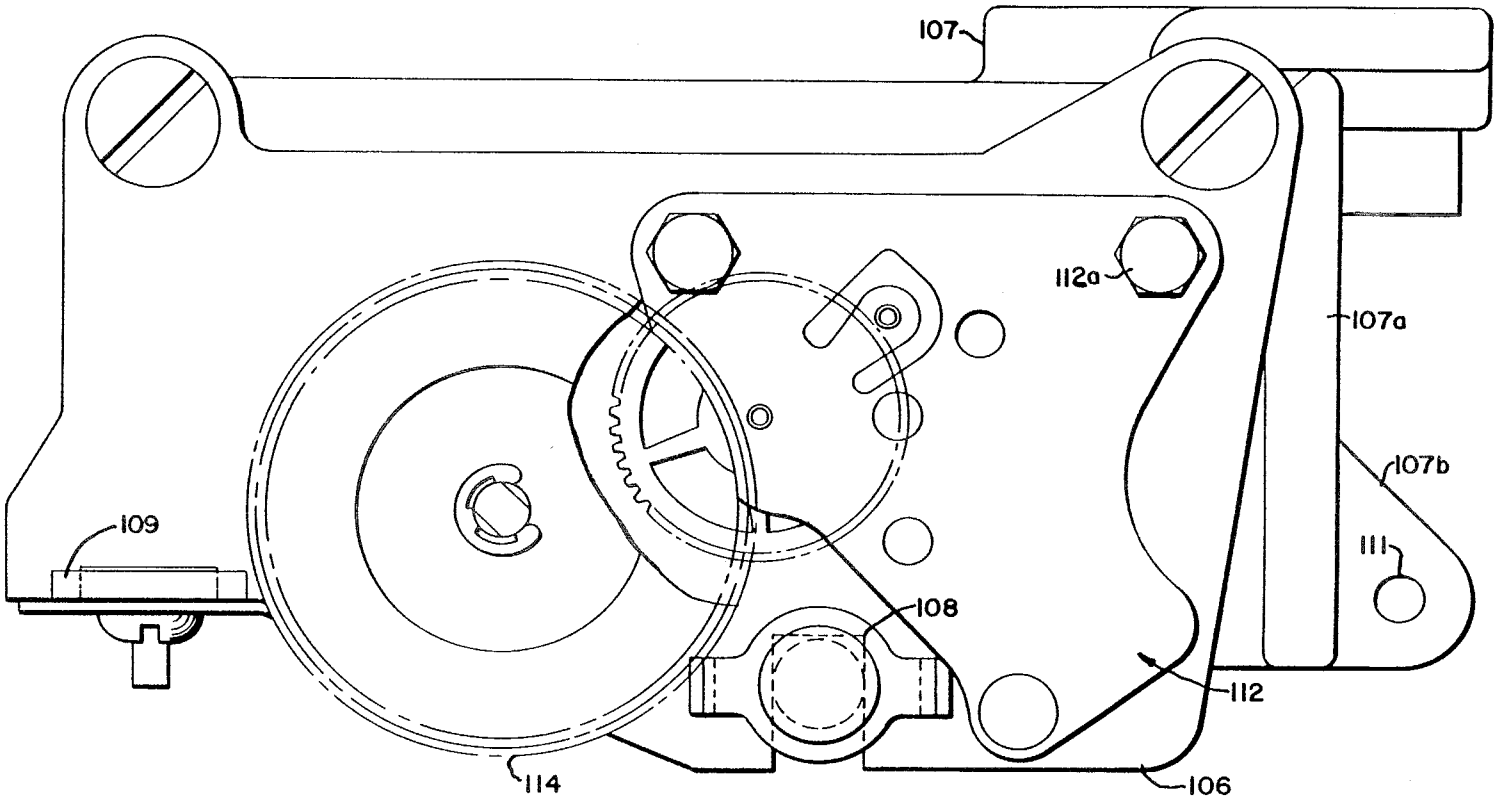
Figure 10:
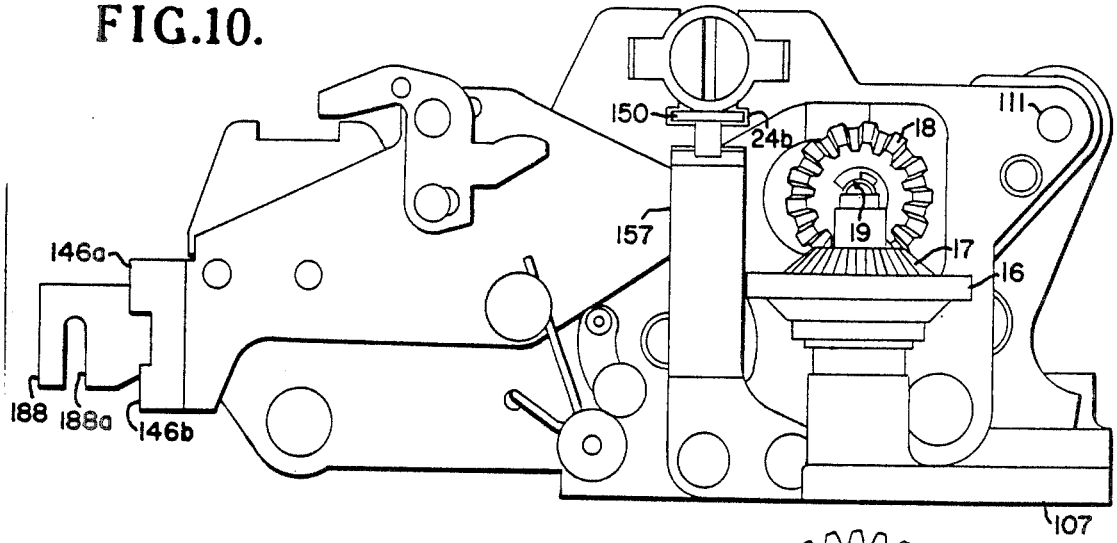
Figure 9:
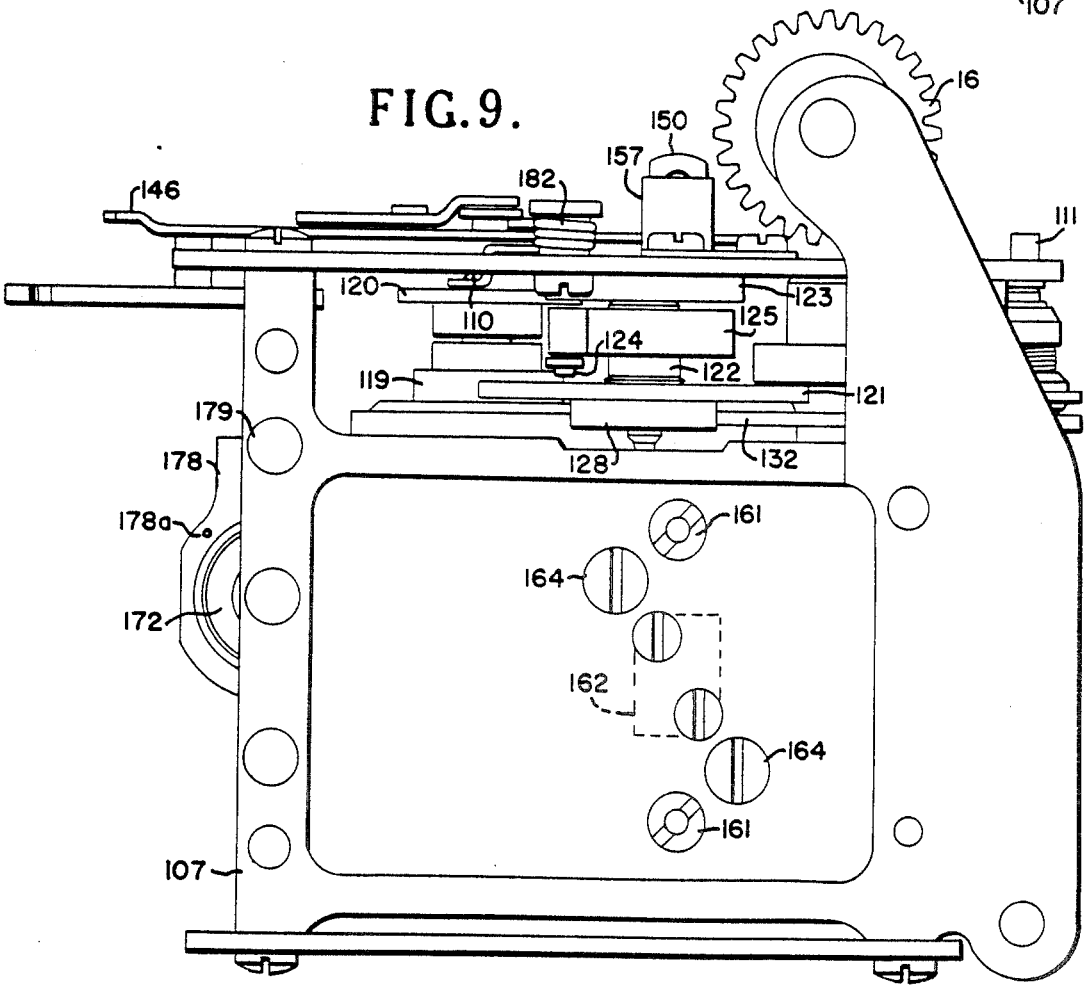

The control unit is framed by side plate 24, escapement plate 106, bottom casting 107, square pillar 108 and cross plate 109 as shown in FIGS. 1, 7 and 15. To these parts within the area bounded by them are mounted the components of the control mechanisms. The two-side plates 24, 106, are also used for the bearings of the pivot ends of timing shaft 110 and cam shaft 19, the shafts 110 and 19 having reduced diameters for this purpose in order to effect an accurate control as to the relationship of the shaft mounted parts to fixed locations of other functional and cooperating units that are mounted to the framework. The shoulders thus formed in shafts 19 and 110, bear against the inner surface of plates 24 and 106 and thus transfer any longitudinal thrust against these plates. The amount of play between the plates 24 and 106 and the shaft shoulders of 19 and 110 is held to close tolerances so as not to sacrifice motion required to move levers etc. under thrust loading or counterbiasing effects. Plates 24 and 106 are treated with a permanently adhering dry film lubricant to obviate the necessity for the use of oils. These spacing members to which plates 24 and 106 are attached are parts 107, 108 and 109.

The bottom casting 107 has a perpendicular extension on an angular form at 107*a*, which supplies a support to mount the components of switches S-2 and S-5, as shown in FIGS. 1, 7 and 17. Also an outwardly extending ear 107*b*, formed in the extension 107*a*, serves to provide support for one end of the shaft 111. The other end of the shaft 111 is supported by plate 24, which has an aligned hole as shown at 24*a*. When mounted, shaft 111 is parallel axially with shaft 119, the alignment of shaft 110 is also parallel with shaft 19 and with pillar 108 and all relatively axial planes.

A pin pallet detached lever escapement 112 of FIG. 7 is mounted to plate 106 on the exterior of the plate; the three mounting screws 112*a* passing through hollow subplate pillars 112*b* of the escapement 112. The escapement is fitted with a non-magnetic balance wheel and is of the double roller type, the impulse pin being carried by an arm of the balance wheel. The safety action is designed specifically to reduce any tendency to wedge the guard prong when the impulse pin is on an arc of its excursion and free of the fork of the lever. To insure this the roller is made as small as possible, consonant with good fork action and balance arc. There are no banking pins provided as the pallet pins bank on the escape wheel. The pallet lever is statically balanced by use of extending horns. The balance staff is pivoted on points in corresponding hollows formed in a hardened plug and screw combination. A regulating arm provides timing rate adjustment by limiting the amplitude of the hair spring within the arc of about 180°. The escapement is made self-starting in that the impulse angle of an escapement wheel tooth lies in the path on a pallet pin when the hair spring has brought the fork of the lever to the zero position of rest. The lock and draw angles are held to a minimum, consistent, of course, with proper escape action, a slight recoil to the timing spring tension upon initiation could be applied to the escapement drive, but this was not deemed necessary. The escapement parts are mounted within the confines of two plates 112*c* and 112*d*, separated by means of two pillars and the three hollow pillars 112*b*. The escapement is attached to the plate 106 as a unit, with the use of resilient washers interleaved between plates 106 and escapement plate lying adjacent thereto. Timing shaft 110 extends through the plate 106 and has a serrated, radially toothed disc 113*a* as part of the clutch 113 attached to its extremity, the clutch disc 113*a* being mounted by means of a slab portion of shaft 110 entering into a conforming hole in the plate; the disc is axially retained by a snap-ring groove shaft 110. A cooperating clutch plate 113*b* is axially slidable on shaft 110 and mounts gear 114.

Gear 114 meshes with the fourth wheel pinion of the escapement 112 and the escapement is driven by shaft 110, when it is actuated by a release pulse from the slide lever. A compression spring 115 envelops a portion of shaft 110 extending beyond plate 106. This spring has a static thrust against a washer 116, which latter lies against the shoulder of shaft 110; and has its moving end thrust against the hub extension of clutch plate 113*b*. The spring action is such that when shaft 110 is turned opposite from the escapement running rotation, in rewinding the timing spring, the clutch plate 113*b* remains locked in static state by reason of the escapement wheel and pallet pins, while the angular slope of the serrated clutch plate teeth cam out the static member 113*b* in an axial direction against the bias of spring 115 until the limit of the retrograde timing shaft movement is reached, upon which the clutch plates engage their mating teeth. This is shown in FIGS. 1, 7 and 15. It will be understood, that clutch plate 113*a* remains stationary in regard to axial movement until it revolves with shaft 110 in retrograde movement; during this time, clutch plate 113*b* remains stationary in regard to angular motion, while it moves axially on shaft 110 as the teeth in the clutch plates override one another. Thus gear 114 shifts a slight amount on the polished fourth wheel pinion leaves of the escapement unit.

Timing shaft 110 carries the following parts: five minute intermediate dead period cam 130, pinned thereto in a definite relationship; vibration and shock bracket 131 axially fastened to base 107 with surrounding shaft 110 with a minimum of radial clearance in order to limit the amplitude of the vibration frequency to less than elastic limit of the shaft and to dampen the vibration as much as possible; the bracket 131 also serving as a static end thrust from the left side of the worm gear 117; worm gear 117 captured between bracket 131 and a snap ring 118 grooved into the shaft 110 and free to turn on said shaft with a minimum of end play; last dead period timing trip and selective setting mechanism I as shown in section in FIGS. 13 and 15, and mounted freeturning, the parts of which will be described later; trip pin disc 129 formed integral with the timing shaft driven pinion 119 and pinned to shaft 110, and the release disc 120, which is also pinned to shaft 110 in a definite relationship with the other attached components.

Refer now to FIG. 13, where driven pinion 119 meshes with timing gear 121, the latter being fastened to a reduced diameter of the winding pinion 128 and thus to the timing spring arbor 122. Arbor 122 is pivoted at one end in the base casting 107 and at the other end in disc 123, this disc being capable of concentric turning with the axis 105 and pivots 122*a* and 122*b*, from the exterior of the plate 124 by the use of a screwdriver. Disc 123 carries spring pin 124 as shown in FIG. 14 riveted to the disc, to which the outer loop of the timing spring 125 is attached and retained by a small snap ring 126*a*. Disc 123 has four tapped holes, 123*a*, in FIGS. 21 and 22, equally spaced in a convolution about axis 105, to accommodate two screws 123*c*. Through the combined use of two slots 24*a* and 24, with any two tapped holes 123*a* the disc 123 may be turned a full revolution, or part thereof, or any number of revolutions in order to properly tension spring 125 for correct escapement arm wheel motion and to place pin 124 in clearance relative to the winding cam 126 on shaft 119, and then clamp to plate 24 by means of two screws 123*c*.

The interloop of spring 125 of FIGS. 7, 13 and 14 is finished with a specially formed slot and this hooks over a cap pin 127 and arbor 122. A slot is formed with a narrow opening toward the spring end, and has this portion extended about twice the diameter, in its length, of the cap of pin 127. The slot is shaped like a key hole and the narrow portion insures spring retention under shock conditions.

The spring 125 is coiled in a loose spiral prior to assembly and before heat treating; being maintained in a preformed state during the process of heat treatment. Spring 125 is made of a non-magnetic corrosion resistant material such as "Elgioy" or "Nilcor" and of a thickness and width that provides sufficient torque to drive the escapement, plus the timing shaft 110 with the frictional drag of the trip pins or the intermediate trip arm 138 on cam 130, as well as that of gear mesh interposed between axis 105 and timing shaft 110 and the loosely following winding segment 132.

Winding segment 132, (of FIGS. 21 and 22) is pivoted on shaft 111 and is guided latterly at its bottom arcuated edge 133 in a slot 134 formed in an extension of bottom casting 107. A roller 135, is loosely fitted to a reduced diameter of stud 136, the latter being riveted to segment 132. A snap-ring 137 retains roller 135 on its axis. The roller extends into the path of a specially formed periphery of the spring winding cam 126 and when the latter cam is in rest position, by reason of stop 101 lying against lever 103 as shown in FIG. 1, the roller 135 can swing beneath the lobe 126*a* of the cam, the amount of swing being proportional to the timed interval either of the intermediate or the last dead period. Hence, when cycling occurs, the cam 126 makes one full revolution and will pick up the roller 135, wherever it may be at time of trip, and restore it to its rest position, the amount of restoration being equivalent to the amount of angular movement represented by the run-down.

When the roller is thus moved by the cam 126, segment 132 winds the timing spring 125 the amount of run-down, through the mesh of the segmental gear teeth with pinion 128, and at the same time effects restoration of shaft 110 to its start position through the agency of gear 121 driving the pinion 119 attached to the shaft 110.

When cycling occurs and before the segment 132 is moved by cam 126, a dwell on the latter part permits trip arms 138 and 139 to clear the three trip pins 140 and the cam 130 so that when shaft 110 is being turned by the action of segment 132, it will not be hindered by these parts during the retrograde movement of shaft 110. This is accomplished by forming and angularly timing the sequence of events, as far as it concerns cam 126, by shaping the curves and interposing the dwells accordingly. In cycling, the special shape of cam 126 functions to inter-relate its duties with those performed by the other components mounted to shaft 19. Cam 126 is pinned to shaft 19.

Axially extending from its surface near the rim, cam 126 carries a pin 141 that coacts with a retrograde lever 142, oscillating from its axis 111, to block any tendency of cam shaft 19 to turn backwards when the counter is hand-wound and set to the ship count. Hence, it will be apparent that the cyling cam shaft 19 is doubly locked from turning either clockwise or counter thereto when once it has completed a revolution, by reason of pin 141 and retrograde lever 142 and also because of the stop pin 101 and trip lever 103 of FIG. 1.

Refer to FIGS. 15, 17, 18, 19 and 20 wherein the trip lever 103 is also protected against malfunction through shock or vibration by the means of a lock extension 143 on the saddle 144, which controls the trip action, said extension being deployed back of a headed, slabbed pin 145 which forms one retainer for the release slide 146 and is fastened to it; only an initiation pulse will start a cycle, as removal of the pin 145 in a direction perpendicular to the direction of movement of the saddle 144 allows the latter to function normally at the end of a dead period interval. The pin 145 also doubles for a guide in a cooperating slot formed in plate 24 so that the release slide 146 is closely positioned relative to its own restoring cam lobe 147 integrally formed with mitre gear 18. In this way release slide 146 is capable of limited movement relative to plate 24 in a direction normal to that of the saddle 144.

The saddle is slidably mounted through slots therein by two headed studs 148, which are fastened in the square pillar 108. Studs 148 pass through the aligned slots 144*a*, which are of a length to permit transverse movement to saddle 144 in respect to the control unit frame and longitudinal movement in respect to the pillar 108.

Refer to FIGS. 1, 7, 12, 17 and 18 wherein the saddle 144 is formed in a shape roughly angular, having two main surfaces at right-angles to one another, the top surface being furnished with three oblong holes, 144*b*, 144*c* and 144*d*, through which pins are passed; one 138*a* from trip-arm 138; one 139*a* from trip-arm 139; and one 103*a* from trip-lever 103. The pins are fastened in their respective levers and arms and interact in a special manner as follows:

When the intermediate dead period side is in governing control, (for all ship counts above no. 2), trip arm 138 is the cyclic actuator and trip arm 139 is restricted by its selector pin 149 in dead period selector 150, the latter being cammed to its left position, in respect to the control unit top view as shown in FIG. 15 in dotted outline, by the control cam 36 of the dial unit assembly acting through the cam follower arm 151. Selector pin 152 controls trip arm 138 by means of lug 153.

Figure 12:
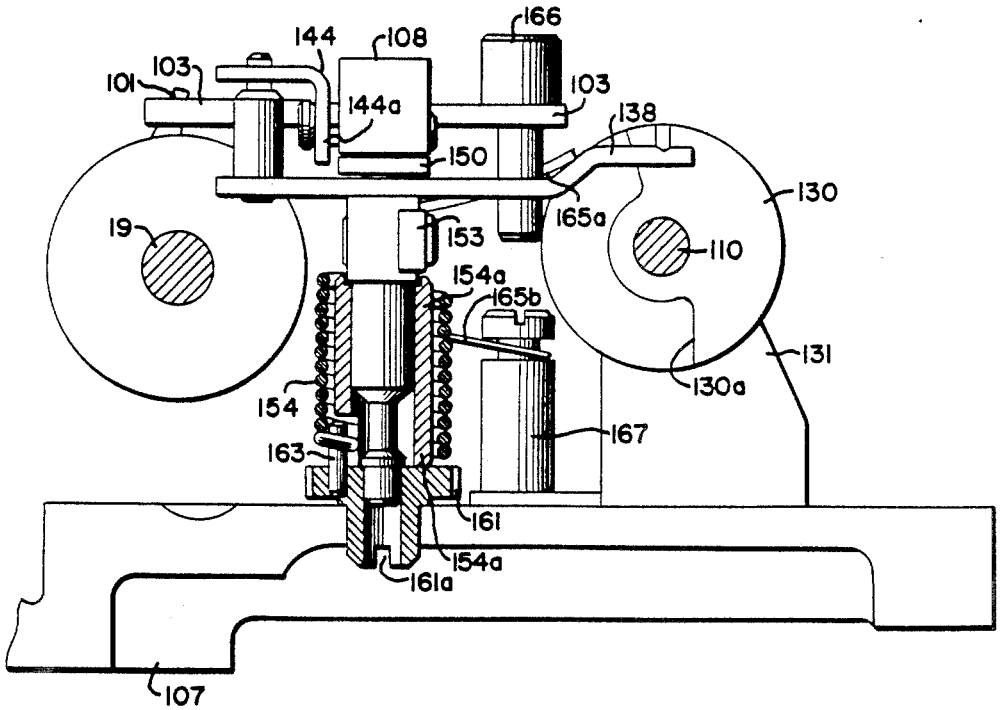

The dead period selector 150 is slidably mounted through a slot 24*b*, of FIG. 15, and at its left end as viewed on FIG. 15, is guided in parallelism with pillar 108 by means of a bearing bushing 108*a* that extends below the bottom of pillar 108 as shown on FIG. 12, and through a slot 150*a* in part 150. There are two bushings 108*a*; one for the five-minute trip-off shaft and one for the selectable interval trip-off shaft. Bushings 108*a* are press-fitted in pillar 108 and receive the upper pivot diameters of the trip-off shafts. In FIG. 12, the dead period selector 150 is constrained by flush-mounted trip-arms 138 and 139, in respect to their shafts, and the under-side of pillar 108, as well as the slot 24*b* in the plate 24.

As stated before, the time interval control for all ship counts above no. 2 is vested in trip-arm 138 coacting with cam 130 and after a lapse of the fixed five minute period a drop-off edge 130*a* will coincide with trip-arm edge 138*b*, in FIGS. 12 and 15, and trip-arm spring 154, which is biasing trip-arm 138 against cam 130, swings 138 counter-clockwise and off the cam edge 130*a*, while its upper end, pivoting at 138*c*, moves the saddle 144 to the left by means of the pin 138*a* pressing against the outer edge of slot 144*b*.

In moving to the left, in FIG. 15, saddle 144 transmits oscillating motion to trip lever 103 by means of slot 144*c* and pin 103*a*, to the extent that separation occurs at 102 between pin 101 and shelf 103*b*. Meanwhile, trip-arm 139 being restricted from any action by its selector pin 149 cooperating with its lug 156, as shown in dotted position in FIG. 15, remains stationary throughout the succeeding cycle and its pin 139*a* does not contact the slot 144*d*.

Trip lever 103 is equipped with a depending roller 103*c*, revolvable on a stud 103*d* fastened into the lever. When tripping occurs, the roller is brought against an annular cam 155, and the consequent cycling event immediately thrusts the roller back somewhat farther than shown in the position of rest on FIG. 15, thereby moving saddle 144 to the right and removing trip-arm 138 from the dropped state in cam 130 and slightly beyond the rest position shown on FIG. 15. The action is such that both trip-arms 138 and 139 are retracted enough to free the selector pins 149 and 152 from any contact with the lugs 153 and 156 in order that, should dial deletion to count no. 2 be in process, the selector is free to move into the last dead period position under the urge of its biasing spring 157 as more clearly shown FIGS. 9 and 10.

During the timing spring winding or restoring phase of the cycle, in which the timing shaft 110 is simultaneously turned backward, the amount of retrogression of the latter is again greater than shown in rest position with release pin 158 when in contact with the notch in release disc 120, as shown in FIGS. 13, 14, 19 and 22.

This is done to assure completion of all cyclic events, including particularly the restoration of the release slide 146, shown in FIGS. 13 and 14, in which pin 158 is fastened; so that the said pin will clear the notch in disc 120 as the latter turns in backward motion while slide 146 is moving pin 158 toward and into the notch of disc 120. Hence, when stop pin 101 terminates the cycle by contacting the trip lever 103 at 102, there will be a few seconds over-run of the escapement to bring the radial, sloping edge of the notch in disc 120 up to and against the release pin 158. In doing this the relative positions of the three pins 140 and their cooperating slots **140*a* in nylon wear disc 140*b* of the last dead period drum 159** are such, that all three are out of phase by approximately 3 deg. or 4 deg. when set to function at the minimum of 15 seconds (¼th min.).

It will be understood that the three trip pins 140 have been turned backwards on shaft 110 while the wear disc **140*b* and the drum 159 were being held stationary; therefore, the pins 140 have been held axially retracted from the disc 140*b* until total backward movement was completed just prior to contact of stop 101 with trip lever shelf 103*b*. The annular cam 155 is so shaped that it provides for this synchronization. The pins 140 and slots 140*a*** are positioned radially to cause no interference with one another.

Refer to FIG. 15 and assume the control governing the cycle has now passed from the intermediate to the last dead period phase; selector 150 has moved to the right by reason of follower 151 entering a notch in cam 36. The ship count has been deleted to count no. 2 and trip arm 138 is now held in restraint by pin 152 acting on lug 153.

Lug 149 has moved to the right and lug 156 is therefore freed to oscillate. Spring 154, of FIG. 12, biases triparm 139, of FIG. 15, and the latter urges drum 159 axially against contact of pins 140 with wear disc **140*b*. At the same time, pivoting at 139*c*, pin 139*a* swings counterclockwise a small amount to effect contact with an edge of slot 144*d* in the saddle 144. The static state is as shown graphically in FIG. 15, with trip-arm 138 held retracted axially from cam 130 by selector pin 152 shown against lug 153** as mentioned above.

After the lapse of the last dead period interval, selectively chosen, trip arm 139 moves drum 159 axially to the right as all three trip pins 140 simultaneously reach coincidence with their respective slots **140*a*, angularly displaced in accordance with the interval setting, through means of the yoke bushing 160 and under the urge of spring 154 associated with the trip-off shaft of trip-arm 139. Pivoting at 139*c*, the upper extension of arm 139 presses pin 139*a* against notch 144*d* of saddle 144 to again move the latter to the left (FIG. 15), causing pin 103*a* in trip lever 103 to actuate the latter through means of slot 144*c* and thus separate shelf 103*b* from contact with stop pin 101** to again start the cycle of winding and restoring as well as dial deletion.

At this point it may be well to mention that the timing shaft 110 is geared to the escapement to produce a rate of one complete revolution in exactly ten (10) minutes. Roughly, only 90% of the ten minute period is used as follows: minimum last dead period setting is 15 seconds; but this includes cycling time of six to eight seconds so that the actual timing by the escapement is only six to seven seconds. As this is true of all settings to and including the maximum of nine minutes, the maximum timing can be only eight minutes and fifty-four seconds, supplemented by the cycling governor of a period that varies from six to seven seconds. However, these figures are well within the permissible limits imposed on the timing of the settings.

A full nine minutes timing or 9/10th turn of the shaft would be equal to 540 seconds and the number of teeth in the clutch 113, as shown in FIG. 15, is made a multiple of this so that by permutating the gear meshes 119–121 and 128–132 relative to cam 126 and release parts 158–120, and optimum condition is found in assembly for the correct functioning of all the parts in synchronized unison. Hence, if 90 teeth are milled into clutch plates **113*a* and 113*b*, each tooth space represents a time interval of six seconds produced. Therefore, retrograde movement of shaft 110 must go beyond six seconds (3 deg. 36 min.) for a minimum, and preferably in multiples thereof; but not exceeding more than 18 seconds over-run. Within these two limits, the said permutation can be accomplished to effect the best running condition for the cycle and this also includes any variable adjustment that may be made necessary to the timing spring 125, after same has been positioned in regard to its pin 124 relative to cam 126. (FIG. 22**).

There are two springs 154, one for each trip-off shaft, and these are held centered by notched sleeves **154*a* as shown typically in FIG. 12 applicable to trip arm 138. These springs have individual tension adjusting means typified by a bearing ratchet 161 (FIGS. 12, 17) click spring 162 and pin 163 fastened into ratchet 161 and to which the lower loop of spring 154 is attached. Ratchet 161 has a reduced diameter extending through the bottom of casting 107 as at 161*a* and is slotted to permit turning in one direction for increasing the spring tension. The upper loops of springs 154 are entered into holes of lugs 153 and 156. These lugs are riveted to and mortised into slots of shafts 138*c* and 139*c* and the trip arms 138 and 139** are securely staked flush to shoulders in said shafts and then pinned axially for keying.

After springs 154 have been adjusted, stop screws 164 are inserted from the bottom of casting 107 and act to lock click springs 162 against the ratchet teeth by means of protruding diameters on screws 164. Spring 162 is made with a double extension to accommodate both ratchets for shafts **138*c* and 139*c*. (FIGS. 15, 17), and is fastened to bottom casting 107**.

As shown in FIGS. 12 and 15, the trip lever shaft 104, to which the lever 103 is staked, has a torsion spring 165 wound around it, one leg **165*a* pressing against an extension of counterweight 166 and the other leg pressing against the bottom of a groove in binding screw 167, the latter also clamping bracket 131 to the bottom casting 107**.

Spring 165 is used to bias trip lever 103 a slight amount toward stop pin 101 and to take up any play counter to the blocking direction at 102 when roller **103*c* leaves its annular track on cam 155 just prior to engagement of stop pin 101 with lever 103. In other words, it insures full shelf contact of member 103*b* with pin 101. The tension in spring 165 does not militate against tripping action as it is of minor extent compared to the tension or urge in the saddle 144** counter to it when the latter is released to trip.

Referring to FIG. 17, shaft 19 is also equipped with a cam 168, the periphery of which cooperates with switch actuator 169 to open and close the contacts of switches no. S-2 and no. S-5. Cam 168 in FIG. 17 is shown in rest position, having opened the contacts by displacing blade 170 (typical of two), and the actuator 169 straddles both blades 170 of the two said switches; both parts 168 and 169 are made of moulded nylon to reduce friction and provide the necessary insulation to ground. It will be noted in FIG. 17 that the spring tension in blade 170 would be effective to cause contact closure when the cam turns and actuator 169 is depressed thereby as shown in dotted outline because the bias in blade 170 is applied beyond the pivot center 169*a* on actuator 169. Therefore the contact pressure is contained in blade 170. Actuator 169 is pivoted at 169*a* and retained in position by means of two studs, one in a bracket 171 and the other in perpendicular alignment therewith in base casting 107.

Figure 11:
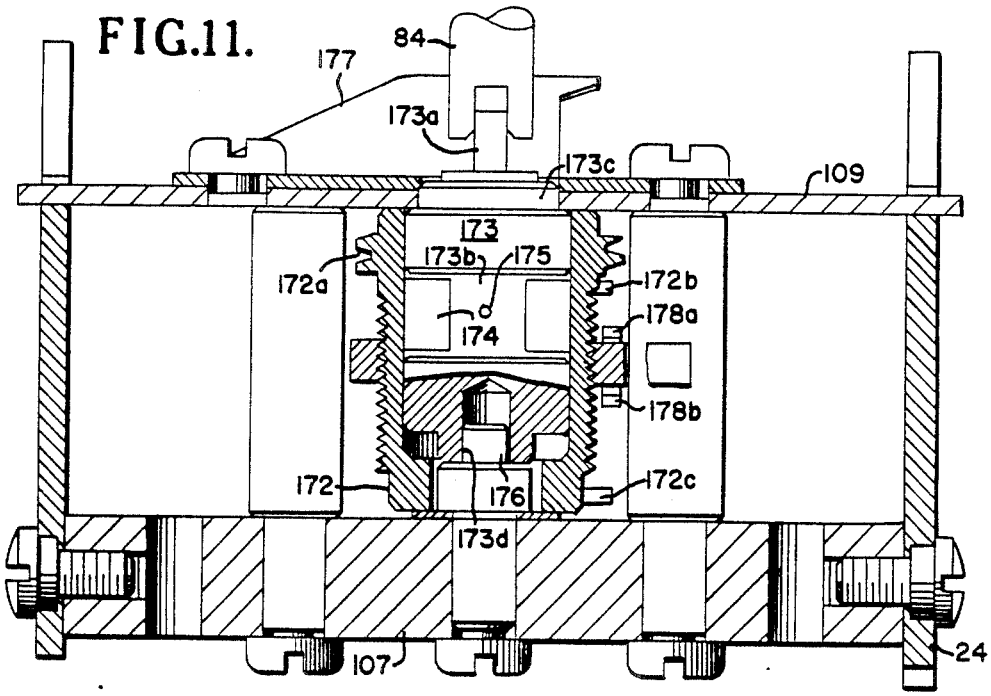

In FIG. 15, the last dead period selecting means comprise yoke bushing 160, pin 160*a*, worm gear 117 meshing with the worm portion 172*a* of a threaded cylinder 172, more clearly shown in FIG. 11 the latter revolvable around a plug 173 which is pivotally mounted at 173*c* in plate 109 and at 173*d* over stud 176. Stud 176 has a reduced diameter for this pivot bearing and is fastened into bottom casting 107.

The plug 173 has a tang 173*a* projecting upward and in axial coincidence with set plug 84 of the cover unit, (FIG. 29, 30), the slot of part 84 fitting loosely over the tang 173*a* to permit of turning from the exterior of the counter. Between plug 173 and cylinder 172 a "C" shaped friction spring 174 is nested in a groove 173*b* of plug 173, the spring 174 having a hole in its center area to fit over pin 175 driven into plug 173. Outward radial tension of spring 174 furnishes a frictional contact against the cylinder bore of part 172, sufficient to transmit turning torque to the latter and to the worm gear 117 and through pin 160*a* to bushing 160 to which drum 159 is attached. Thus, turning plug 84 on the counter exterior provides rotary motion transmitted to drum 159 in order to select the time interval desired.

A pointer 177 is fastened to plate 109 and the indicia on drum 159 are thus visibly indicated. The cylindrical threaded part 172 has a four thread worm cut into its upper portion and this cooperates with worm gear 117, which has 40 teeth, so that one turn of the tang 173*a* of the plug 173 equals 1/10th turn of the drum 159. This is equivalent to one minute in time indication.

Because the minimum setting is ¼th minute and the maximum is 9 minutes and each minute equals one turn of the cylinder 172, a total of 8-¾ turns is required to span the entire range of the selectable time field represented by the indicia on the drum 159, starting with the ¼th minute setting.

As seen in FIGS. 7, 11 and 15, a threaded nut 178 in the form of a yoke is positioned on mating threads on the cylinder 172 and the yoke arms straddle pillar 179, which construction prevents any turning of the nut 178 as cylinder 172 is turned Thus nut 178 can travel up and down on part 172 a limited amount.

This travel is used to provide limit stops at the ¼th minute and nine minute indications, while the intermediate settings are made freely available. To do this, nut 178 is provided with two slabbed pins, 178*a* and 178*b*, the first projecting upward and the second downward therefrom. Cylinder 172 is equipped with two cooperating slabbed pins, 172*b* and 172*c*, the first at the upper end of the thread and the second at the lower end, and both extending radially outward. The angular position of pin 172*b* in reference to pin 172*c* is 90 degrees of arc in a convolution about the cylinder axis. This is equal to the ¼th minute excluded from the total of nine full turns, and the positioning of pins 178*a* and 178*b* are likewise spaced in nut 178 90 degrees apart. The threads in parts 172 and 178 are cut 32 per inch so that each convolution represents a lead or travel of nut 178 of 1/32", which is the amount of overlap, less a clearance, of pins 172*b* and 178*a* at the time of their engagement at the upper end of part 172; likewise, when the two cooperating pins contact one another at the lower end of 172, the overlap equals ¾×1/32 or 0.023". The lower pins are 172*c* and 178*b*.

Thus, these parts form a revolution counter and limit the number of turns possible to cylinder 172 to 8¾, and when the limits at either end are reached, there is no wedging experienced in the worm and gear mesh because the stop pins are on the screw threads and not on the drum 159 or associated parts. Continued turning of plug 84 after a stop is encountered, merely causes slippage between the friction spring 174 and the inner bore of cylinder 172.

The release slide 146 is slidably mounted on plate 24 which is supplied with three slots to accommodate three guide studs fastened into the part 146, in FIGS. 17–20 as follows. Stud 145, which is also the locking stud for the saddle 144, in slot 146*c*; stud 186 in slot 146*c* and stud 187 in slot 146*e*. The studs and slots permit of a limited movement to release slide 146 in relation to plate 24 and the use of enlarged diameters and collars retain the release slide in position. Studs 186 and 187 extend through the plate 24 and have the switch actuator 188 fastened thereto. Part 188 opens switch no. S-1 after initiation, by having a notch 188*a* (FIG. 19) straddling a switch blade 189 of switch no. S-1 (FIG. 15). The width of notch 188*a* is such that when retraction of slide 146 occurs, the outer edge of the notch pulls blade 189 against the contacts a slight amount and then drops to rest position against cam 180, leaving blade 189 to maintain its pressure of approximately 70 grams between the closed contacts. Thus, switch no. S-1 is conditioned to open upon the first drop action of the release lever 146 of FIG. 18 into cam slot 180*a* and against the outer diameter of cam 181 by edge 146*b*, which amounts to about 0.040" or the difference in length of edges 146*a* and 146*b*.

When initiation occurs, release lever is normally moved into the cam notches in two steps; one drop or step when the pulse is received and the second step after switch no. S-1 has opened and the initiator segment lever has restored the lower of two axially coincident cams 180 and 181 to a position of rest. When edge 146*a* falls into the notch of the top cam 180 of the initiator, it prevents the latter from following cam 181 in the restoring action, due to a light spring couple between the two cams. The first drop does not release pin 158 from edge 120*a* of the timing release disc 120; but it moves it farther outward on the slope (see FIG. 14) as shown in the middle dotted position. Being sloped, the disc 120 is never-the-less relieved from the restraint of pin 158, so the torque of the timing spring begins to start the escapement, which is now free to run, and thus move edge 120*a* toward pin 158. Before contact here is again made between these two parts, the "hot" wire of the initiator has cooled due to the cessation of current flow by reason of opening of switch no. S-1 and cam 181 is turned clockwise to align the notches 180*a* of both cams 180 and 181. This results in the second drop of release slide 146 by reason of edge 146*b* entering into the notch of cam 181. This second step in the movement of the release slide fully removes pin 158 from the disc 120 so the escapement continues to run for the timing period desired.

The above construction features permit of several advantages, plus the attaining of a necessary safety measure:

a. Timing of interval begins immediately upon initiation.

b. Static and sliding friction between pin 158 and notch 120*a* is eliminated due to the slope of the edge 120*a*.

c. Provides safety by preventing cycling if the initiator "hot" wire has broken and thus makes the unit a "dud". This last feature is particularly important because, with a single step action, breakage of the wire would result in repeated, continuous cycling with the release slide moving back and forth as the dial count is deleted until at count no. 1 arming takes place and the detonator switch no. S-3 is prematurely closed.

d. Does not free the saddle 144 for operation on the first drop by total removal of the blocking pin 145, so that the trip lever 103 and stop 101 remain locked until the final second drop of the release slide 146 has occurred.

Referring to FIGS. 13, 15, 17, 18, 19 and 20, pin 158 is shown riveted securely in release slide 146 and extending through a slot in plate 24 to effect restraint in release disc 120.

The release slide 146 is biased toward cams 180–181 by the torsion of spring 182 coiled around the retainer stud 185 attached to plate 24. Spring 182 has one leg 182*a* pressing against a headed pin 183 in slide 146 and the other leg, 182*b* formed to pass through a hole 184 in plate 24 with a perpendicular section of the leg 182*b* pressing against the hole edge counter to the torsional moment.

As stated previously, the edges of slide 146 disposed adjacently to the initiator and signified by references 146*a* and 146*b* are offset by an amount of about 0.040"; the edge 146*a* extending beyond that of 146*b*. The cams 180–181 have outside diameters substantially alike; thus the double initiation action first releases edge 146*a* to enter into notch 180*a* and banks edge 146*b* against cam 181, and then in reciprocation, turns cam 181 to present its notch 181*a* under edge 146*b* to complete the initiation stroke. Cam 180, being under static load for great lengths of time and having the full thrust of spring 182 concentrated in a small area on the cam surface near the drop-off notch, was furnished with a very smooth, chromium plated metal band to prevent identation of the nylon material of which both cams are composed. This hard-facing is not applied to cam 181, because it is only momentarily in contact with the edge 146*b* during an initiation period.

Figure 18:
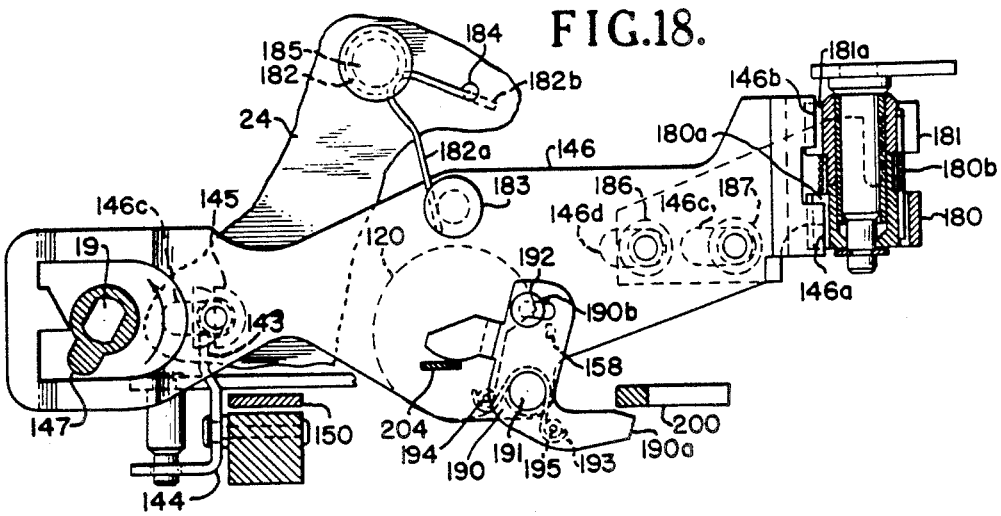

FIGS. 17, 18 and 20 show the release slide 146 in the fully dropped condition with both edges 146*a* and 146*b* entered into their respective cam notches as explained. FIG. 19, however, shows the release slide retracted from the cams 180–181 due to cycling, and at its maximum retrograde travel. The action results from cam lobe 147, integral with miter gear 18, on shaft 19, turning when cycling and lifting cam portion 189 of the release slide 146. The amount of retraction is sufficient to allow cam 180 to turn under the edge 146*a* of the slide by means of the couple in spring 180*b*, of FIG. 18.

Carried on slide 146 is a pivoted, spring-biased latch 190 swiveling at 191 and guided by means of a pin 192 through a slot 190*b* which permits of limited angular motion to the latch 190. A spring 193 is coiled around the hub of the latch and has one leg resting against a pin 194 in slide 146 and the other leg against a pin 195 in the latch urging the latter into a rest position as shown in FIG. 19.

Latch 190 has one sole function; to release the trip latch 200 of the contact no. S-3 upon receipt of the last initiation pulse. This it can do only after count no. 1 is reached by the ship count dial 37 and the detent 204 has been removed by the truncated, conical pin 40*b* in the groove 40*a* of gear 40 on the DIAL UNIT (see FIGS. 4 and 16). Prior to this occurrence, all cycling and initiations are performed with latch 190 held retracted from the trip latch 200 by detent 204 as shown in FIG. 18. Even if the trip latch 200 were moved from stop 202 before the counter reaches count no. 1, the switch no. S-3 could not be closed because of the reset arm holding cam 201 in the position shown in FIG. 17, for all counts down to no. 1 cam 201 turns on pivot 203 in plate 35.

Spring 196, coiled around the pawl hub 142*a* keeps the pawl 142 against stop 197 and thus in position to intercept pin 141 in cam 126 when the pin backs up in winding and setting the counter. In cycling, the pin 141 passes beneath and displaces the pawl 142, which drops behind it when the cycling is stopped. One leg of the spring 196 enters a hole in the pawl 142 and the other rest against stop pin 197. The winding segment 132 is staked onto a shoulder of the bushing 132*a* and the retrograde pawl hub 142*a* is slipped over the bushing 132*a* and retained axially by a snap-ring 142*b*. Shaft 111 is grooved to receive a retaining ring 111*a*, which fixes it in axial position.

The foregoing is a complete description of the parts and functions of the control unit. The parts for switches no. S-2 and no. S-5 have not been separately enumerated as they are fully illustrated in cross-sectional view in FIG. 7 and are typical of one another.

An attempt has been made to illustrate the manner and sequence of the operations, but a short review of these may help to clarify the description made part by part:

Cycling shaft 19 is spring loaded and restrained by the stop 101–103. Timing shaft 110 is spring loaded and restrained by release pin 158 in slide 146. Slide 146 is spring loaded against the initiating cam 180. When the initiating pulse is received, cam 180 turns a small amount and notch 180*a* comes under the edge 146*a* of slide 146. The slide drops (in two steps) and releases pin 158 to start the escapement for timing the interval. Shaft 110 turns until an axial displacement of the concerned trip arm takes place to remove the trip lever 103 from the stop pin 101, which starts the cycling of the shaft 19. Shaft 19 turns one revolution, restoring the tripping means; resetting the timing means; retracting the release slide; winding the timing spring; closing and opening switches no. S-2 and no. S-5 and stopping itself once again upon contact of parts 101 and 103. This is one complete cycle of the control unit.

The dial unit is shown in FIGS. 1, 4, 15 through 20, 27 and 28, the dial unit as shown in FIG. 1, occupies the right half of the counter space in the housing 1. This unit comprises the ship count dial; detonator switch no.

S-3 and associated control and tripping means; the control cam to select the governing dead period interval in the control unit and the cycling interval governor with associated drive train. Also, the ship count dial drive train and dial pointer.

These units are mounted to or between two main plates and the dial drive train is furnished with two sub-plates for the two pinion shafts of the gear reduction to the dial gear from the drive gear on the operating drum beneath.

The top plate 35 is spaced from the bottom plate 205 by means of four pillars 206 riveted in plate 205 with plate 35 set over reduced shoulder diameters of pillars 206 and held securely with four screws 207. The dial unit is mounted in the housing unit by means of four screws 208 (FIG. 1), threaded into upwardly projecting pillars in bosses and lugs 1*a*, cast into housing 1. The disconnect of the power drive from the power spring 13 is the interlocking gear mesh between gears 44 and 45 as shown in FIGS. 4 and 4*a*.

Reference was made in the housing description to the construction and alignment of parts and functions of the dial unit and may find some repetition here in furthering the dial unit description. However, the plate 209 (FIG. 4), is part of the housing and has bearing 210 fastened into it, said bearing having also a concentric enlarged diameter 210*a* that acts to axially locate the dial unit by entering into the bore of socket 34 in plate 35. Plate 209 is shaped in a spider form as shown in FIG. 1 and the fastening means are the same screws 208, that attach the top plate 35 to the housing pillars. The three pillars that support the plates 35 and 209 have reduced diameters as extensions to dowel both plates.

Mentioned previously, the ship count dial 37 is fastened to the control cam 36 by means of four screws 38. Cam 36 is made of nylon and revolves around socket 34, being retained by a snap-ring 211 nesting in a groove in part 34 and against a recessed surface of cam 36. Cam 36 has two formed notches in its rim, one at 36*a* cooperating with follower lever 151, said lever also engaging the end of selector 150; and one at 36*b* cooperating with reset arm 212, pivoting at 213 in plate 35.

Switch cam 201 is spring tensioned to revolve on its axis 203 and when released by removal of trip latch 200 from restraint of stop 202, acts to cam the lower contact blade 214 of switch no. S-3 against the upper contact 215 and lock same in this state. An extension of cam 201 is positioned over blade 214 as shown in FIGS. 1, 17 and 27 at 201*a*, which is normally the state of switch no. S-3 through all ship count cyclings. This acts to lock blade 214 out of possible contact closure due to shock applied to blade 214.

Cam 201 is molded of nylon and has the configuration as shown in FIG. 27, including stop 202 formed integral in the molding operation. Stop 202 is of approximately the same thickness as cam 201 proper and has five gear teeth formed in it to engage corresponding gear teeth of the reset arm 212 as shown. A radial protuberance on cam 201, which extends slightly beyond the outer rim, is formed to match the thickness of stop 202 and projects into the path of the trip latch 200 to act as a restraining lock against the torsional urge of spring 203*d* illustrated in FIG. 28. As shown in this figure, the cam assembly consists of shaft 203*b* molded into cam 201 as an insert. A bushing 203*a* is staked to plate 35 and forms a bearing for shaft 203*b* as well as a thimble for spring 203*d*.

The end of shaft 203*b* is slabbed with two parallel flats to key into a conforming hole in spring detent 203*c*, the latter being securely fastened to shaft 203*b* by means of a headed screw 203*e*. A stud 35*a* is riveted to plate 35 and provides a stop for one leg of spring 203*d*, while the other leg is entered into a hole of detent 203*c*. In this way, a torsional moment about axis 203 is established that urges cam 201 to close contacts 214–215 of switch no. S-3.

Trip latch 200, also made of nylon, is pivoted at 216 in plate 35 and has a hole into which an extended, reduced diameter of a stud 216*a* is inserted as a bearing, an enlarged portion of the stud forming a retainer for the spring 216*c*, one leg of which is bent upward into a hole in part 200, the other leg is bent around the head of screw 217. A washer 216*d*, having a hole size equal to the enlarged diameter of stud 216*a* rests between spring 216*c* and trip latch 200 so that, due to end play, the upper coil of the spring will not wedge between the stud 216*a* and latch 200. Snap-ring 216*b* retains the trip latch on the stud and the lengthened head of screw 217 also acts as a stop for the latch.

Reset arm 212 is pivoted at 213 in plate 35. Headed pin 213*a* is press-fitted in arm 212 and the smaller diameter extends through a bushing 213*b* attached to plate 35. Snap-ring 213*d* retains the pin 213*a*, being set into a groove of the latter. Bushing 213*b* has a milled slot 213*c* on one side, set normal to the pivot point 218 of follower lever 151 as shown in FIGS. 27, 28. Hence, lever 151 is guided in the plane of movement at its outer end in proximity to cam 36. Hub 151*a* is staked into lever 151 at its pivot end, which bears on a stud 218*a*, fastened into plate 35. A snap-ring 218*b* retains the lever.

In the FIGS. 1 and 27, the relationship of the parts of the dial unit thus far mentioned, are such that count no. 1 is indicated on the dial and in this position, lever 151 is entered into its notch in cam 36; switch cam 201 is biased against latch 200 and the upper end of reset arm 212 is slightly projecting into its cooperating cam notch, which has appeared directly beneath this part after the cycling from count no. 2. Also, pin 40*b* has appeared over the rider 204*a* in detent 204, depressing the latter and oscillating it about its pivotal connection 204*b* in plate 35 and against the tension of the flat spring 204*c*, attached to plate 35 at one end of same (not shown). This raises the tail end of 204 so that the latch 190 is released from any restraint of part 204 and consequently its spring 193 urges end 190*a*, FIG. 19, downward from the position shown in FIG. 18 and in the retracted state of the release slide 146, behind the protruding lobe of trip latch 200. It is apparent that the next initiation pulse would cause the latch 200 to be tripped and spring 203*d* to revolve cam 201 to physically close the contacts of switch no. S-3. The notch in cam 36, directly under the end of the reset arm 212, permits the latter to oscillate when spring 203*d* closes switch no. S-3. This notch appears only after count no. 1 is reached, thus the switch no. S-3 is locked out from closure during all intermediate ship count cyclings, regardless of the trip latch 200. The protruding end of reset arm 212 normally "rides" on the periphery of cam 36, which causes a slight retraction of the stop on cam 201 from the trip latch 200, so that the latter is free to be oscillated without affecting the cam 201.

In FIG. 16, the conical pin 40*b* has a flat formed by truncation of the part; the extent of this flat dimensionally, is calculated to provide the tolerance of plus or minus 0.032" at the indicating pointer and dial graduations of the ship count dial 37. Hence, if the setting originally chosen is within these limits, the actuation counter will function properly through all its phases down to arming and finally, closure of the switch no. S-3.

Illustrated in FIGS. 1, 27 and 28, switch No. S-3 is composed of lower blade with contact point 214, the blade being of a flexible nature; upper semi-rigid arm 215 with its matching contact point; spacer 219; bracket 220; insulators 221; cap 222; screws 223 and screws 217 and 224, the latter two binding bracket 220 to plate 35.

The governor to control the cycling time consists of gear 225 meshing with gear 15 from which it receives its driving torque, gear 226 on shaft 227 with gear 225; gear 226 meshing with the first intermediate pinion 228 on shaft 229 with gear 230; gear 230 meshing with the second intermediate pinion 231 on shaft 232 with gear 233; gear 233 meshing with pinion 234 on click shaft 235 with click wheel 236 and the latter having teeth in engagement with two pallets on oscillator 237, which is mounted to shaft 238 pivoted in plates 35 and 205. All the shafts mentioned above are thus pivoted in the said plates, having reduced diameters of highly polished surfaces entering into the pivot holes that are first treated with a solid film lubricant and then ball-burnished and sized.

The click wheel 236 is made of nylon and the oscillator 237 of aluminum, in order to depend as far as possible, not so much on the inertial effects to obtain the cycling time interval, but more on the frequency of the oscillations in stopping and reversing the oscillator in its vibrations. By making the entire drive train with low inertial effects, the starting torque is held to a minimum, this being especially important close to the oscillator due to the gear ratios involved back to the drive gear 225. At the expense of about 0.50 inch/lbs, torque on the operating drum, a timing for a cycle of approximately 6 to 7 seconds is obtained.

The selector 150 of the control unit has its end engaging the lever 151 and motion cam 36 is thus transmitted to the selector. By having lever 151 interposed between cam 36 and selector 150, a longitudinal thrust on selector 150 is attained, against the bias of spring 157 acting on pin **150*a* in the part 150, as shown at 150*b* (FIG. 15), without causing binding in slot 24*b***.

The point of contact **150*b***, also forms the point of disconnect when assembling the dial and control units in the housing unit.

To recapitulate: The dial unit function comprises selection and setting of the ship count dial; control of the cycling time; control of the selector to phase the dead period timing interval; safety means to automatically prevent closure of switch no. S-3 until the actuation counter has been armed, and control of the detent means that prevents switch closure until the count no. 1 has coincided precisely with the indicator pointer.

The initiator unit is illustrated in FIGS. 1, 2, 15, 17, 18, 23 through 26 and is so called because the first move to start the actuation counter emanates from this unit. Actually, it is a means, other than magnetic, to release spring-loaded elements within a confined, nonaccessible container.

When current is passed through a resistance wire made of "Nichrome V" or its equivalent, within certain limits the wire can be heated while under a specific strain to produce an elongation that is proportional to the current and the strain applied, and upon removal of the current flow the wire will contract to its prior state, still with the same strain applied, without acquiring a permanent set.

The amount of elongation permissible is a function of the wire diameter, its length between rigid supports and the strain applied.

Tests have indicated that repetitive cycles of this treatment, up to 2,000 tested, will not alter the original tensile strength sufficiently, or creep enough to cause maloperation of the initiator if the resultant expansion is small in extent and remains such that the elongation limit in the heated condition does not exceed either the time of expansion or the rate thereof naturally produced by the current (approximately 0.50 Amp.). Only sufficient strain is used to properly and safely operate the initiator cams 180–181, and this tension is confined in such a manner that the wire is relieved thereof after having expanded a definite amount, said amount being within the so-called elastic limit of the wire under the specific load and under a specific temperature. In other words, the strain or pull on the wire produced by the spring tension may not be so great as to cause an abnormal reduction in cross-sectional area upon elongation, if said reduction is not being "time-rated" to the natural period for the amount and extent of the current applied, in order to avoid "plastic flow".

Upon cooling, contraction of the wire results and this feature is used to restore the spring operating couple of the initiator to its prior state of rest.

Figure 24:
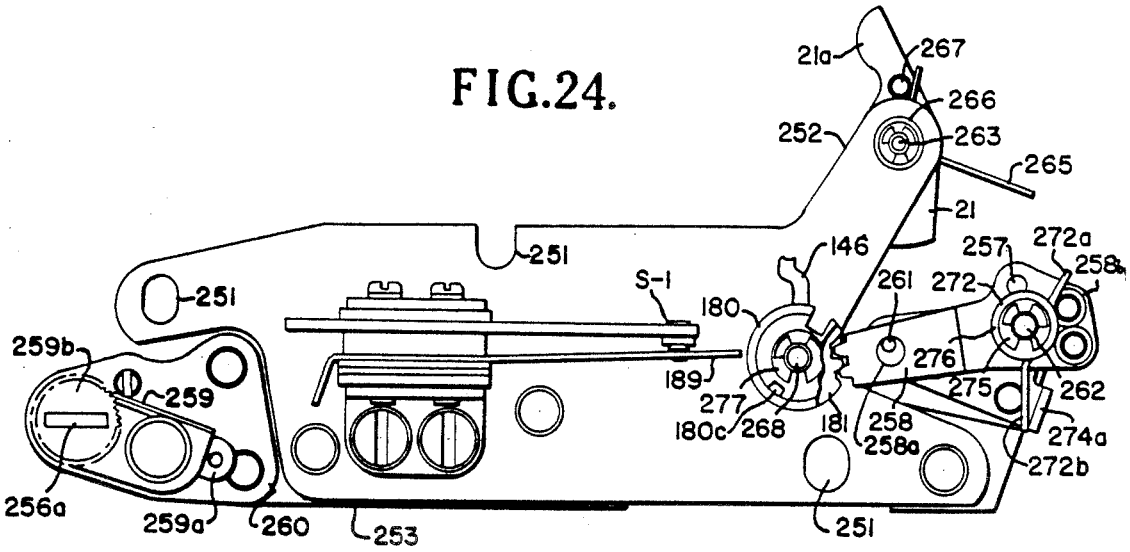

In FIG. 1, the initiator unit is shown generally by the indication No. 5 and is mounted by means of three screws 250, threaded blind into bosses **1*a* of the housing. These screws pass through slots 251 in plate 252 (FIG. 24). Slots are used in order to provide a small amount of adjustment toward or away from edges 146*a*–146*b* of the release slide, to properly position the location of the control unit and the initiator unit in terms of the desired double-drop action of part 146**.

The initiator assembly consists of the top plate 252, riveted to an insulator plate 253 with mica insulator 254 interleaved, said plate 253 having a channel **253*a* in which the "hot" wire 255 passes from its point of attachment to the thumb screw shaft 256 in hole 256*a*, to its point of attachment to pin 257 in actuator arm 258. The channel 253*a* is made narrow and the depth is such that the crosssection of same would show the wire 255** occupying, as far as possible, the middle state of the area thus produced. Being closely confined within the channel walls of insulating material and by the roof of mica insulation, any deviation from straightness would encounter contact with a rigid surface by the wire, if such is the result of shock or vibration; thus the method used offers means of dampening and protection from sidewise distention. In normal state the wire does not touch the walls of the channel.

Figure 23:
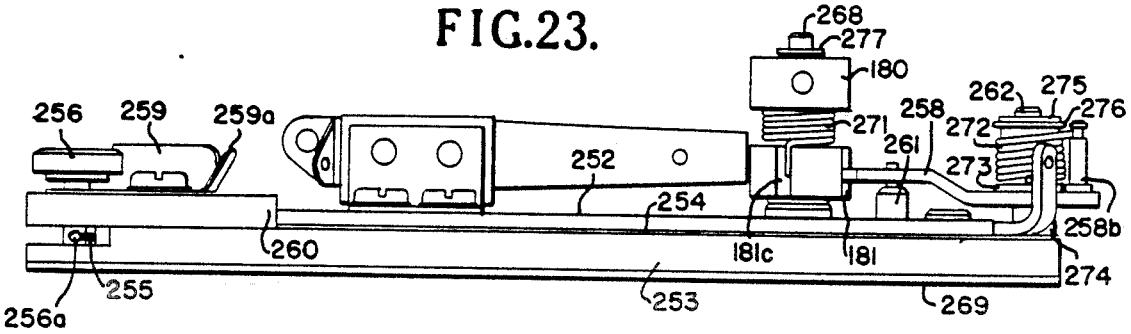

Refer to FIGS. 23 and 24 where thumb screw 256 has a serrated head in the form of fine ratchet teeth and a click spring 259 has a bent flat portion that forms a pawl for the ratchet teeth of part 256. A yoke **259*b* is formed on the end of part 259 and coacts with a groove 256*b* to retain part 256 in its counterbored recess 260*a* of insulator block 260**.

Thumb screw 256 and the click spring 259 thus provide a means for tensioning the wire 255 by steps of about 0.007" in length for each ratchet tooth space, to take up any slac and also to bring the pin 261 against the upper edge of hole **258*a* as shown in FIG. 24. It will be seen, that part 258, the actuator arm, has pin 257 placed close to the pivot 262, while the two teeth formed into part 258 at the left end, which coact with teeth in cam 181, are placed far from pivot 262, in relation about 5 to 1 as regards pin 257 This ratio acts to multiply the small extent of the wire expansion in order to turn the cam 181** a sufficient amount.

Click pawl 21 is pivoted at 263 in plate 252, the stem of a stud 263*a* passing upward through a thimble bearing 264 staked into plate 252. A spring 265 surrounds thimble bearing 264, having one leg normally against pin 267 in pawl 21 and the other leg against a pillar boss 1*a* in housing 1, as shown in FIG. 2. The spring 265 places tension on pawl 21 and the arcuate upper portion 21*a* is pressed into a tooth space of count wheel 20. Ring 266 is a snap-ring to retain the click pawl assembly in position.

Post 268 forms a pivot bearing for the initiator cams 180–181 and is fastened into the composite base of the initiator, the shank of which forming a rivet member for assembling the parts 252, 253, 254 and 269, the latter being an insulator plate, and designed to cover any "live" riveting or projecting parts and insulate same from the bottom of housing 1.

Cams 180–181 are arranged so that they are interlocke in relationship to the teeth in 181, notches 180*a*–181*a* in both and spring recesses 180*c*–181*c* in both. Cam 180 is capable of a limited amount of rotation on the thimble 270, relative to cam 181; the angular amount is dependent upon the angular space between the edges of the interlocking means, which consist of reduced diameters 180*b* and 181*b* that are in the form of a key in one and a coacting notch in the other, being held together by the resiliency of torsion spring 271, having two bent legs. One of said legs is bent to rest in notch 181*c* and the other in notch 180*c*, in the state of rest shown in FIG. 24.

FIG. 24 also illustrates the notch 180*a* tilted in rest position with the release slide 146 against the outer chromium band of cam 180; the notch 181*a* is shown in relationship so that when cams 180–181 are turned counterclockwise in unison, upon receiving an actuation pulse through the actuator arm 258, the right edge of notch 181*a* will be under the release slide edge before the left edge of notch 180*a* has departed therefrom; thus the release slide will make the first drop against the outer rim of cam 181 and into the notch 180*a*. This action is accompanied by a relief in torsion of spring 272, the amount being sufficient to turn the cams, until pin 261 engages the opposite side of hole 258*a* in actuator arm 258.

Figure 25:
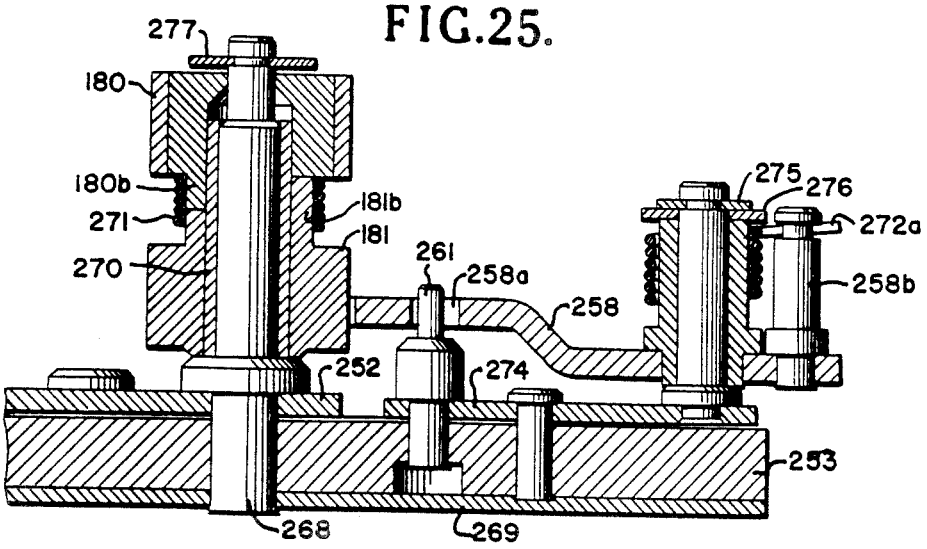

Spring 272 is coiled around hub 273, staked in part 258 and has one leg 272*a* against a balancing stud 258*b*, of which two are mounted in part 258. The other spring leg, 272*b*, is tensioned against an upwardly bent terminal tab 274*a*, formed in part 274, the latter being the support plate for stud 262 that pivots the actuator arm assembly. Plate 274 is riveted to the insulator plate 253 with a portion of insulator 254 interleaved. A snap-ring 275 retains the actuator arm 258 and spring 272, being positioned in a groove in part 262 and having a washer 276 between it and spring 272. A snap-ring 277, grooved into stud-stem 268 retains the initiating cam assembly (FIGS. 23, 24, 25).

When the switch no. S-1 is opened upon the first drop of the release slide 146 onto cam 181, current flow is interrupted to the "hot" wire and cooling takes place. In cooling, the wire returns to its initial length and in shortening thus, moves the actuator arm 258 so that the hole 258*a* engages the pin 261 on its opposite side; this action also restores the full tension of spring 272 and turns the cam 181 clockwise, so that the release slide edge now makes its second drop into notch 181*a*, thus starting the timing cycle. Inasmuch as cam 180 cannot move during this second drop of the slide 146, the torsion spring 271 between the cams 180–181 is slightly tensioned as these two are separated angularly, thus tending to restore the initial state of rest when the slide is retracted.

When the release slide 146 is retracted after cycling, it moves a little farther from the periphery of the cams, so that the latter are free to turn clockwise, as far as cam 180 is concerned, by reason of the spring tension in spring 271. This brings the rim of cam 180 under the release slide edge, effectively locking it out of action until another initiation pulse is received.

Switch no. S-1 has corresponding parts equivalent to those of switch no. S-3 and need not be enumerated. The difference between the two switches resides in the fact that no. S-1 is biased closed, while no. S-3 is unbiased, but normally in open state.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. In a mine of the type to be disposed within a body of water adjacent the path of travel of a vessel comprising a source of power, a detonator, detector means for generating an electrical pulse in response to a disturbance in the terrestrial magnetic field adjacent to the mine, an actuation control means electrically connected to said detector means for receiving said generated electrical pulse, said actuation control including a normally open switch and a ship counter, said ship counter including a settable rotatable dial means having a plurality of successive positions, one position being a firing position for closing said normally open switch, said dial means being initially manually set, motor means for sequentially and interan rotating said dial means from one of the successive positions to the next succeeding position after being energized by said electrical pulse until said dial means reaches the firing position, delay means connected to said motor means for preventing a second actuation of said motor means in less than a five minute interval after the first actuation said delay means further comprising means for selectively changing the delay period which immediately precedes firing, a firing circuit comprising said source of power, said detonator and said normally open switch whereby when said dial means rotates to the firing position and closes the normally open switch the firing circuit is energized to fire the mine.

2. A system for selectively controlling the firing of a mine comprising a detonator, a firing circuit, said firing circuit including a source of electrical power, a pair of normally open electrical contacts and said detonator all being electrically connected in series, a detector for sensing a change in the magnetic field adjacent said mine and generating an electrical signal in respose to said change, actuation control means including an initiator means, a ship counter means, delay means and cam means, said ship counter means having a rotatable manually settable dial means which has a plurality of successive positions, one position being a firing position at which position said normally open contacts are closed, said ship counter means further comprising motor means connected to said dial means and to said initiator means for sequentially and intermittently rotating said dial means from one of the successive positions to the next succeeding position upon being actuated by said initiator means until said dial means reaches the firing position, said delay means being connected to said motor means to prevent actuation thereof until a predetermined period of time has elapsed since the immediately preceding actuation has occurred, said delay means further comprising means for selectively varying the delay period which immediately precedes the firing position, said cam means being connected to said normally open contacts and to said motor means to close said normally open contacts in said firing circuit when said dial means is rotated to the firing position.

3. A system as defined in claim 2 wherein the delay periods between the actuations of said motor means are of at least five minutes duration except for the delay period immediately preceding firing, which is variable from onequarter minute to nine minutes.

4. A system as defined in claim 2 wherein the initiator means further comprises an actuator arm pivoted intermediate the ends thereof, a first end of the actuator arm being connected to a resistance wire which has its other end secured to a mounting means to prevent movement thereof, said wire being held under tension between said actuator arm and said mounting means and being electrically connected to said detector so that a signal generated by said detector will pass through said wire heating said wire and causing thermal expansion thereof, the second end of the actuator arm having gear teeth formed thereon for cooperation with a gear mounted upon a shaft, initiator cam means mounted on said shaft, said initiator cam means comprising a first cam and a second cam each having a notch therein, the notch in said first cam being radially angularly displaced from the notch in said second cam when said first and second cams are in their rest position, release means connected to said motor means to normally restrain actuation of said motor means and being cooperable with said first and second cam means, an initiator switch electrically connected between said resistance wire and said detector and being operably controlled by said release means whereby when said detector generates a signal the heat generated by said signal flowing through said resistance wire causes elongation of said wire reducing the tension on said wire which angularly rotates said actuator arm and said first and second cams, when the release means falls into the notch in said first cam the release means opens the initiator switch interrupting the flow of current through the resistance wire which cools the wire, the cooling of the wire causes the wire to contract and rotate the actuator arm and second cam so that the release means may fall into the notch in said second cam thus initiating said motor means.

5. A system as defined in claim 2 wherein said cam means includes means to positively lock said normally open contacts from closure until completion of all but one cycle of said actuation control means.

6. A system as defined in claim 3 wherein said cam means includes means to positively lock said normally open contacts from closure until completion of all but one cycle of said actuation control means.

7. A system as defined in claim 4 wherein said cam means includes means to positively lock said normally open contacts from closure until completion of all but one cycle of said actuation control means.

8. A system as defined in claim 4 wherein the delay periods between actuations of said motor means are of at least five minutes duration except for the delay period immediately preceding firing, which is variable from one-quarter minute to nine minutes.

9. A system as defined in claim 2 wherein said dial means further comprises a clutch means which enables the dial to be rotated beyond the desired setting and continuously rotated in the same direction back to the desired setting without necessitating run down of the motor means or harmful and undesirable counter-rotation of the dial means.

10. A system as defined in claim 4 wherein said dial means further comprises a clutch means which enables the dial to be rotated beyond the desired setting and continuously rotated in the same direction back to the desired setting without necessitating rundown of the motor means or harmful and undesirable counter rotation of the dial means.

* * * * *